US008864487B2

(12) United States Patent
Bailey

(10) Patent No.: US 8,864,487 B2
(45) Date of Patent: Oct. 21, 2014

(54) POTTERY HOLDING DEVICE AND METHOD

(76) Inventor: James G. Bailey, Kingston, NY (US)

( * ) Notice: Subject to any disclaimer, the term of this patent is extended or adjusted under 35 U.S.C. 154(b) by 222 days.

(21) Appl. No.: 13/406,101

(22) Filed: Feb. 27, 2012

(65) Prior Publication Data

US 2012/0216659 A1 Aug. 30, 2012

Related U.S. Application Data

(60) Provisional application No. 61/447,276, filed on Feb. 28, 2011.

(51) Int. Cl.
*B28B 1/02* (2006.01)
*B28B 17/00* (2006.01)

(52) U.S. Cl.
CPC ..... *B28B 1/025* (2013.01); *B28B 17/00* (2013.01); *Y10S 425/033* (2013.01); *Y10S 425/12* (2013.01)
USPC ..... 425/266; 425/267; 425/268; 425/459; 425/186; 425/400; 425/263; 425/3; 425/DIG. 33; 425/DIG. 120; 269/57; 269/203; 269/303; 269/304; 409/163; 409/164; 409/165; 279/133

(58) Field of Classification Search
CPC ..... B28B 1/025; B28B 1/02; B28B 7/0002; B28B 7/0014; B28B 7/0017; B28B 7/002; B28B 17/00; B28B 5/06; B28B 21/00; B28B 21/76; B29C 33/20; B29C 33/202; B29C 33/12; B29C 33/123; B29C 33/126; B29C 33/14; B29C 33/16; B29C 33/30; B29C 33/303; B29C 33/304; B29C 33/305; B29C 33/32; B29C 33/36
USPC ..... 425/263, 265, 266, 267, 268, 459, 425/DIG. 120, 3, 182, 186, 400, 402, 468, 425/DIG. 29, DIG. 33; 269/57, 203, 303, 269/304; 279/133; 409/163, 164, 165
See application file for complete search history.

(56) References Cited

U.S. PATENT DOCUMENTS 337,632 A 3/1886 Sheldon
1,602,122 A 10/1926 Reed (Continued)

FOREIGN PATENT DOCUMENTS

DE 2354040 * 10/1973 ..... B28B 11/00
GB 142588 A * 5/1920 ..... B28B 1/02

(Continued)

OTHER PUBLICATIONS http://warmglass.com/phpBB/viewtopic.php?f=2&t=22857. See Mar. 7, 2007 post by Bob Stephen on p. 3.4 and Mar. 22, 2007 post by Denise DeMarco on p. 7.

*Primary Examiner* — Seyed Masoud Malekzadeh
(74) *Attorney, Agent, or Firm* — Heslin Rothenberg Farley & Mesiti P.C.

(57) ABSTRACT

A pottery holding device and method for securely holding a workpiece during rotation and working of the workpiece on a wheelhead of a pottery wheel. The pottery holding device includes a wheelhead member and at least three holding members. The wheelhead member configured for attachment to the wheelhead of a pottery wheel. The at least three holding members and wheelhead member configured to allow selective locking of the at least three holding members in positions about the periphery of a workpiece. The device adapted to securely hold circular, non-circular symmetric and irregular, asymmetric or organic shaped workpieces. The device further adapted to securely hold workpieces in positions and orientations such that the center of the workpieces is aligned with the axis of rotation of the device, and positions and orientations such that the center of the workpieces is spaced from the axis of rotation of the device.

18 Claims, 20 Drawing Sheets

(56) References Cited

U.S. PATENT DOCUMENTS

| | | | | | |
|---|---|---|---|---|---|
| 1,759,058 | A | * | 5/1930 | Miller | 264/87 |
| 2,884,698 | A | | 5/1959 | Wursch | |
| 2,968,080 | A | * | 1/1961 | Threlfall | 269/304 |
| 3,286,537 | A | * | 11/1966 | Riley | 476/51 |
| 3,386,140 | A | * | 6/1968 | Bruckner | 425/3 |
| 2,849,054 | A | | 11/1974 | Jordache | |
| 4,222,577 | A | * | 9/1980 | Giffin | 279/114 |
| 4,585,240 | A | * | 4/1986 | Giffin | 279/111 |
| 4,689,001 | A | * | 8/1987 | Yoder | 425/183 |
| 5,180,174 | A | * | 1/1993 | Province | 279/6 |
| 5,783,123 | A | * | 7/1998 | Edwards et al. | 264/39 |
| 5,971,379 | A | | 10/1999 | Leon, Jr. | |
| 7,114,933 | B2 | * | 10/2006 | Adachi et al. | 425/3 |
| 7,261,543 | B2 | | 8/2007 | Lester | |
| 7,641,464 | B2 | * | 1/2010 | Griffin et al. | 425/267 |
| 2005/0025850 | A1 | * | 2/2005 | D'Estais | 425/263 |
| 2007/0200278 | A1 | | 8/2007 | Lester | |
| 2008/0258336 | A1 | * | 10/2008 | Lester | 264/219 |

FOREIGN PATENT DOCUMENTS

| | | | | | |
|---|---|---|---|---|---|
| GB | 970077 | A | * | 9/1964 | B28B 1/02 |
| GB | 2179587 | A | * | 3/1987 | F16D 1/06 |

* cited by examiner

POTTERY HOLDING DEVICE AND METHOD

FIELD OF THE INVENTION

The present invention relates to the field of pottery, and, in particular, to devices and methods for selectively securing a preformed shape of pottery to the wheelhead of a pottery wheel during rotation.

BACKGROUND INFORMATION

A pottery wheel, also known as a potter's wheel or potter's lathe, is a machine used to facilitate forming, trimming, decorating and other manipulation techniques of pottery. At a basic level, a potter's wheel is a device that provides rotation to a workpiece or "form", such as an unformed piece of clay or a preformed shape. As the art of pottery has existed for centuries, pottery wheels have taken many different forms. A typical modern-day pottery wheel includes a frame, a power source (such as a motor or kickwheel) and a wheelhead coupled to the power source such that the power source rotates the wheelhead. Some pottery wheels include attached work tables and splash pans that surround the wheelhead to catch any trimmings or other debris thrown off the wheelhead by centrifugal force as the wheelhead rotates.

The wheelhead provides a rotating planar upper-surface on which a potter can work a workpiece or form. Wheelheads can take any form and size, but a typical wheelhead is a planar disc of metal or other sturdy material, such as cast aluminum, and includes concentric markings or rings on the top surface about the center of the wheelhead. The concentric markings or rings aid a potter in centering a workpiece, especially a workpiece with a circular or other symmetrical profile.

Wheelheads often also include mechanisms for selectively attaching a bat (also known as a batt or batten) to the upper surface of the wheelhead. A batt can allow for removal of a workpiece from the wheel without damaging or deforming the workpiece. A batt can also simply provide an alternative working surface to suit a potter's tastes. For example, some potters prefer to shape or "throw" clay on plaster, therefore bucket-style wheelheads have been designed to allow for plaster bats. However, wheelheads more commonly include bat pins and/or bat pin apertures that mate with corresponding bat pins or bat pin apertures in the bat to secure the bat to the wheelhead. Such mechanisms aid in adding centripetal force to a bat to secure the bat to the wheelhead such that the bat rotates with the wheelhead and is prevented from disengaging from the wheelhead due to centrifugal force.

Similar to bats, other devices are occasionally applied to the upper surface of a wheelhead via the bat pins and bat bin apertures to facilitate certain pottery processes. In particular, prior art devices for centering and temporarily holding pottery forms, such as semi-pliable greenware bowls, cups and vases, on the wheelhead are known in the art. Such devices aim to reduce or eliminate off-center rotation, wobble and the like to facilitate shaping, forming and finishing of workpieces. More specifically, some devices facilitate the removal of excess clay from the bottom area of the workpiece to create a foot. A foot is typically a circular ring on the bottom of the workpiece formed by the removal of material with a trimming tool as the workpiece rotates on the wheel. The foot provides a level (if desired) stable base for the workpiece. With circular workpieces, or other symmetrical forms, the foot is usually formed about the center of the workpiece so that the workpiece is symmetric and thus aesthetically pleasing.

One popular prior art wheelhead device for centering and temporarily holding pottery forms to facilitate shaping and formation of a foot is the Giffin device, disclosed in U.S. Pat. No. 4,222,577. The Giffin '577 device essentially is a three jaw self-centering chuck, like the typical chuck of a power tool. The Giffin '577 device uses three sliding arms (like the jaws of a common chuck) interconnected via a spiral groove in a bottom plate (i.e., a scroll plate) to center and hold a workpiece. As the spiral groove is concentric about the center of the bottom plate and the movement of the sliding arms is fixed with respect to one another (i.e., the sliding arms move in unison), the sliding arms self-center a circular workpiece placed therebetween as they slide within the spiral groove and move towards the center of the plate. In this way, the sliding arms of the Giffin '577 device securely hold and self-center a circular workpiece.

One of the drawbacks encountered with prior art wheelhead devices for centering and securely holding workpieces is that they can only provide three points of contact with the outer surface of a workpiece, such as with the Giffin device described above. While three points of contact may be sufficient to secure circular or three-sided workpieces, three points of contact are not sufficient for some uniquely shaped workpieces. For example, square, rectangular, other multi-sided forms with 4 or more sides, oblong, bisymmetric, asymmetric, abstract curvilinear and other non-circular, irregular or "organic" shapes often cannot be fully supported with three points of contact. When these types of irregular or organic workpieces are not fully supported, they may slide, twist or otherwise move on the device during rotation thereof. Movement of workpieces during rotation prevents a potter from being able to create a circular foot, can break or distort the workpiece, or, in the worst case scenario, can eject the workpiece from the pottery wheel.

Another drawback encountered with prior art wheelhead devices for centering and securely holding workpieces is that the support members of the devices are spatially locked with respect to one another and the center of the device (thus the support members move in unison) and are positioned symmetrically about the center of the device. Therefore, in the prior art devices with three support members, the support members are equally spaced with respect to the center of the device and each support member is spaced about 120 degrees from an adjacent support member. In such a fixed symmetric relationship, the support members are unable to fully support an irregular or organic workpiece—as it is likely that only two support members will contact a workpiece.

Similarly, even symmetric non-circular workpieces will not be fully supported by the fixed symmetrically disposed support members of these prior art devices. In use of such devices with support members in a "locked" arrangement, a single support member will likely first contact the exterior surface of the workpiece. If the support members are further extended toward the center of the device, the lone support member contacting the workpiece will push or twist the workpiece until at least one other support member contacts the outer surface of the workpiece. At this stage, the workpiece is not fully supported. If the support members are extended even further, the support members will either deform the workpiece or the workpiece will further slide and/or until another support member contacts the outer surface of the workpiece. At this point, if the device only has three support members (as in the prior art), the workpiece has been translated about the device into an arrangement where the outer surfaces of the workpiece that are in contact with the support members are radially equidistant from one another and from the center of the device. However, because the workpiece is non-circular, the true center of the workpiece is not aligned with the center of the device. In such a non-centered arrangement, a foot cannot be formed in the center of the workpiece, and the potter has no ability to select the position of the foot. Further, as is understood in the art, such pushing and twisting of the workpiece about the device will scratch, deform or otherwise mar the workpiece. Still further, in all likelihood, an irregular or non-circular symmetric workpiece will not define three outer surface locations that are radially equidistant from one another and from a central point, and therefore a third support member would never reach the outer surface of such a workpiece (at least without deforming the workpiece).

Yet another drawback encountered with prior art wheelhead devices for centering and securely holding workpieces is that the workpieces, including circular workpieces, cannot be selectively secured in locations other than the center of the device. For certain processes, a potter may wish to secure a workpiece off-center from the axis of rotation. For example, in order to apply glaze in an uneven and aesthetically pleasing pattern, potters would prefer to place a workpiece off-center and apply a glaze soaked applicator against the outer surface of the workpiece. By keeping the applicator in the same position with respect to the axis of rotation, the off-center rotation or "wobbling" of the workpiece would create thinner, wider and/or random patterns of glaze on the workpiece's outer surface. Further, the location of the foot of workpieces cannot be chosen by the potter. As described above, prior art devices are self-centering because the support members are in a fixed relationship and symmetrically opposed about the center of the device. Thus, these prior art devices automatically center and support a workpiece (i.e., when the last support member contacts the outer surface of a circular workpiece, the workpiece is centered and fully supported). Thereby, such an arrangement and configuration of the support members in the prior art devices prevents a potter from securing workpieces anywhere else besides the center of the device (including circular workpieces), i.e., the self-centering feature prevents the potter from deciding where to secure a workpiece. As a result, the prior art devices do not allow a potter to select the secured position and orientation of a workpiece, and therefore do not allow the potter to elect where the foot of a particular workpiece should be formed, such as circular workpieces, or apply such an "uneven" glaze process.

Still further, the fixed symmetrical arrangement of the support members of prior art devices does not allow the potter to control where irregular shaped workpieces are secured on the devices (assuming an irregular shaped workpiece can actually be secured). Even if a prior art wheelhead device can secure a particular irregular or asymmetric workpiece without destroying the workpiece, the workpiece would be automatically positioned (as discussed above), and the potter thus had no ability to select the secured position. As a result, the prior art devices do not allow a potter to select the secured position and orientation of an irregular or non-circular symmetric workpiece, and therefore do not allow the potter to elect where the foot of a particular irregular or non-circular symmetric workpiece should be formed.

Another drawback encountered with prior art wheelhead devices for centering and securely holding workpieces is that the devices are thick and thereby significantly elevate workpieces with respect to the wheelhead. A thick wheelhead device, and therefore an elevated workpiece, will allow trimmings or other debris thrown off the wheelhead by centrifugal force to be thrown at a higher trajectory as compared to if the device was not used. Splash pans are typically designed or configured based on the height of the wheelhead of a potter wheel. Therefore, if a particular pottery wheel includes a splash pan, workpieces that are significantly elevated with respect to the wheelhead will tend to throw trimmings or other debris past or over the splash pan. As such, prior art wheelhead devices for centering and securely holding workpieces that are thick tend to elevate workpieces to such an extent that they eliminate or reduce the debris capture advantages of splash pans.

Yet another drawback encountered with prior art wheelhead devices for centering and securely holding workpieces is that they only function properly with a particular direction of rotation. Prior art devices are designed for either clockwise or counter-clockwise rotation of the pottery wheel. Prior art devices, like the Giffin device described above, include support members held in slots of a top plate and in a spiral groove of a bottom scroll plate. The spiral groove provides for translation of the support members within the slot along a radius of the device as the scroll plate and top plate rotate with respect to one another (i.e., as the support members move angularly along the spiral, they move closer or farther away from the center of the device). However, the spiral groove is limited to providing movement towards the center of the device only when the support members rotate about the spiral groove either in a clockwise or counter-clockwise direction, depending upon if the spiral groove spirals from the outer edge to the center in a clockwise or counter-clockwise direction. As a result, if a clockwise designed prior art device were installed on a pottery wheelhead that rotated counter-clockwise, the support members would be biased away from the workpiece during rotation of the wheelhead, and thus fail to support the workpiece. The same lack of support would occur if a counter-clockwise designed prior art device were installed on a pottery wheelhead that rotated clockwise.

Accordingly, it is an object of the present invention to overcome one or more of the above-described drawbacks and/or disadvantages of the prior art.

SUMMARY OF THE INVENTION

The present disclosure is directed to devices and methods for securely holding a workpiece during rotation of the workpiece. The disclosed devices and methods have particular utility with rotating workpieces on wheelheads of pottery wheels. In exemplary embodiments, the disclosed devices are configured for attachment to a wheelhead of a pottery wheel for securely holding a workpiece thereon during rotation of the wheelhead and device.

In accordance with one aspect of the present invention, a device includes a wheelhead member including a substantially planar bottom surface configured to engage at least a portion of the top surface of a wheelhead, and a substantially planar top surface defining a working surface for acceptance of a workpiece thereon. The device may also include at least three holding members configured to abut a workpiece that has been placed on the working surface of the wheelhead member. In some embodiments, the at least three holding members are independently movable with respect to one another and the wheelhead member, and each of the at least three holding members are manually engageable to facilitate movement of the holding members between at least two positions. In some such embodiments, the at least two positions may include: (1) a first position wherein the at least three holding members abut at least three separate and distinct points of said workpiece, and each holding member being selectively locked with respect to the wheelhead member to securely hold the workpiece to substantially maintain the position and orientation of the workpiece during rotation of the wheelhead and device; and (2) a second position wherein the at least three holding members are spaced from the first position to allow the workpiece to be placed on, or removed from, the working surface of the wheelhead member.

In some embodiments, the wheelhead member may include at least two apertures extending from the bottom surface towards the top surface, and the at least two apertures being shaped and sized to at least partially receive a bat pin of the wheelhead therein. In embodiments where the wheelhead member defines a substantially circular shape when viewed from the axis of rotation of the wheelhead when the wheelhead member is coupled to the wheelhead, the at least two apertures may be positioned in the wheelhead member such that when the wheelhead member is coupled to a wheelhead a bat pin is at least partially received in each aperture and the center of the wheelhead is substantially aligned with the axis of rotation of the wheelhead.

In accordance with another aspect, the wheelhead member may include a magnetic material disposed substantially throughout the wheelhead member when viewed from the axis of rotation of the wheelhead when the wheelhead member is coupled to the wheelhead. In some such embodiments, the at least three holding members may include a magnetized member. In some such embodiments, in the first position the at least three holding members may be selectively locked with respect to the wheelhead member due to the magnetic attraction between the holding members and the wheelhead member. Further, in the second position the at least three holding members may be either removed from the working surface of the wheelhead member or are magnetically coupled to the wheelhead member and spaced from their location in the first position.

In accordance with another aspect, the wheelhead member may include at least three slots extending from the bottom surface to the top surface, and each of the at least three holding members may be coupled to a slot. In some such embodiments, the wheelhead member may define a substantially circular shape when viewed from the axis of rotation of the wheelhead when the wheelhead member is coupled to the wheelhead, and the slots may be symmetrically disposed about the circular shape of the wheelhead member and extend substantially linearly along radiuses of the wheelhead member.

In some embodiments, each holding member may be configured to be slidably coupled and selectively locked to its corresponding slot. In some such embodiments, each holding member may include a sliding member adjacent the bottom surface of the wheelhead member and a slot, a stop member adjacent the top surface of the wheelhead member and the slot, and a locking member coupled to the stop member, the slot and the sliding member. In some such embodiments, each slot may include a recess disposed about the slot in the bottom surface of the wheelhead member, and the sliding member may be threadably coupled to the locking member and positioned at least partially within the recess of the particular slot such that it is prevented from substantially rotating within the recess.

In some such embodiments, rotation of the locking member in a first direction may draw the locking member and the sliding member toward one another, and in the first position the locking member may have been selectively manually rotated in the first direction to such a degree that the sliding member exerts force against the recess and the stop member exerts force against the working surface to selectively lock the holding member to the wheelhead member.

In some embodiments, the holding members may be moved from the first position to the second position by manual rotation of the locking member in a second direction that is substantially opposite to the first direction to such a degree that the forces between the sliding member, stop member and wheelhead member are reduced to a degree that the holding member is slidably coupled to the wheelhead along the slot, and by manually sliding the holding member away from the center of the wheelhead.

In some embodiments, the stop members may be substantially disc-shaped. In other embodiments, the stop members may be substantially L-shaped.

In some embodiments, the device includes at least four holding members. In some such embodiments, the wheelhead member thereby includes at least four slots and corresponding recesses. In some such embodiments, the at least four holding members abut at least four separate and distinct points of a workpiece. Such embodiments may be particularly advantageous for four-sided, non-symmetrical and organic shaped workpieces.

In accordance with another aspect, the present invention may be directed toward a device that may include first means for engaging the top surface of a wheelhead and for accepting a workpiece thereon, and at least three second means for abutting a workpiece positioned on the first means. In some such embodiments, the at least three second means may be independently movable with respect to one another and the first means, and wherein each of the at least three second means is manually engageable to facilitate movement of the second means between at least two positions. In some such embodiments, the device may be configured such that the at least two positions include: (1) a first position wherein the at least three second means abut at least three separate and distinct points of said workpiece, and each second means being selectively locked with respect to the first means and each other to securely hold the workpiece to substantially maintain the position and orientation of the workpiece during rotation of the device; and (2) a second position wherein the at least three second means are spaced from the first position to allow the workpiece to be placed on, or removed from, the first means.

In accordance with another aspect, the first means may be a wheelhead member including a substantially planar bottom surface configured to engage at least a portion of the top surface of a wheelhead, and a substantially planar top surface defining a working surface for acceptance of a workpiece thereon, and the at least three second means may be at least three holding members.

In some embodiments, the wheelhead member may include a magnetic material disposed substantially throughout the wheelhead member when viewed from the axis of rotation of the wheelhead when the wheelhead member is coupled to the wheelhead, and the at least three holding members may include a magnetized member. In some such embodiments, in the first position the at least three holding members may be selectively locked with respect to the wheelhead member due to the magnetic attraction between the holding members and the magnetized member.

In accordance with another aspect, the wheelhead member may include at least three substantially linear slots symmetrically disposed about the wheelhead member extending from the top surface to the bottom surface, and each holding member may be coupled to a slot. In some such embodiments, each holding member may include a sliding member adjacent the bottom surface of the wheelhead member and a slot, a stop member adjacent the top surface of the wheelhead member and the slot, and a locking member coupled to the stop member, the slot and the sliding member. In some such embodiments, rotation of the locking member in a first direction may draw the locking member and the sliding member toward one another to such a degree that the sliding member exerts force against the bottom surface of the wheelhead member and the stop member exerts force against the working surface of the wheelhead member to selectively lock the at least three holding members to the wheelhead member.

In some embodiments, the device includes at least four holding members. In some such embodiments, the wheelhead member thereby includes at least four slots and corresponding recesses. In some such embodiments, the at least four holding members abut at least four separate and distinct points of a workpiece. Such embodiments may be particularly advantageous for four-sided, non-symmetrical and organic shaped workpieces.

In accordance with another aspect, the present invention may be directed toward a method for securely holding a workpiece during rotation of the workpiece on a wheelhead of a pottery wheel. In some embodiments, the method may include the step of coupling a wheelhead member to a wheelhead of a potter wheel, and the step of independently manually repositioning at least three holding members configured to abut a workpiece that has been placed on the working surface of the wheelhead member from a first position to a second position wherein the at least three holding members abut at least three separate and distinct points of said workpiece, and each holding member being selectively locked with respect to the wheelhead member to securely hold the workpiece to substantially maintain the position and orientation of the workpiece during rotation of the wheelhead and device. In some such embodiments, the wheelhead member may include a substantially planar bottom surface configured to engage at least a portion of the top surface of a wheelhead, and a substantially planar top surface defining a working surface for acceptance of a workpiece thereon. In some such embodiments, in the first position the at least three holding members may be spaced from the second position to allow the workpiece to be placed on, or removed from, the working surface of the wheelhead member.

In accordance with another aspect, the wheelhead member may include a magnetic material and the at least three holding members may include a magnetized member, and the step of independently manually repositioning the at least three holding members from the first position to the second position may include positioning the at least three holding members on the working surface of the wheelhead member in abutment with the workpiece at at least three distinct locations to selectively lock the at least three holding members with respect to the wheelhead member due to the magnetic attraction between the holding members and the wheelhead member.

In accordance with another aspect, the wheelhead member may include at least three substantially linear slots symmetrically disposed about the wheelhead member extending from the top surface to the bottom surface, and each holding member may be coupled to a slot. In some such embodiments, each holding member may include a sliding member adjacent the bottom surface of the wheelhead member and a slot, a stop member adjacent the working surface of the wheelhead member and the slot, and a locking member coupled to the stop member, the slot and the sliding member. In some such embodiments, the step of independently manually repositioning the at least three holding members from the first position to the second position may include rotating the locking member in a first direction and drawing the locking member and the sliding member toward one another to such a degree that the sliding member exerts force against the bottom surface of the wheelhead member and the stop member exerts force against the working surface of the wheelhead member to selectively lock the at least three holding members to the wheelhead member.

In some embodiments, the method includes the step independently manually repositioning at least four holding members configured to abut the workpiece that has been placed on the working surface of the wheelhead member from the first position to the second position. In some such embodiments, the at least four holding members abut at least four separate and distinct points of the workpiece. Such embodiments may be particularly advantageous for four-sided, non-symmetrical and organic shaped workpieces.

Other objects, aspects and advantages of the pottery holding devices of the present invention, and/or of the currently preferred embodiments thereof, will become more readily apparent in view of the following detailed description of the currently preferred embodiments and the accompanying drawings.

DETAILED DESCRIPTION OF PREFERRED EMBODIMENTS

Figure 1:
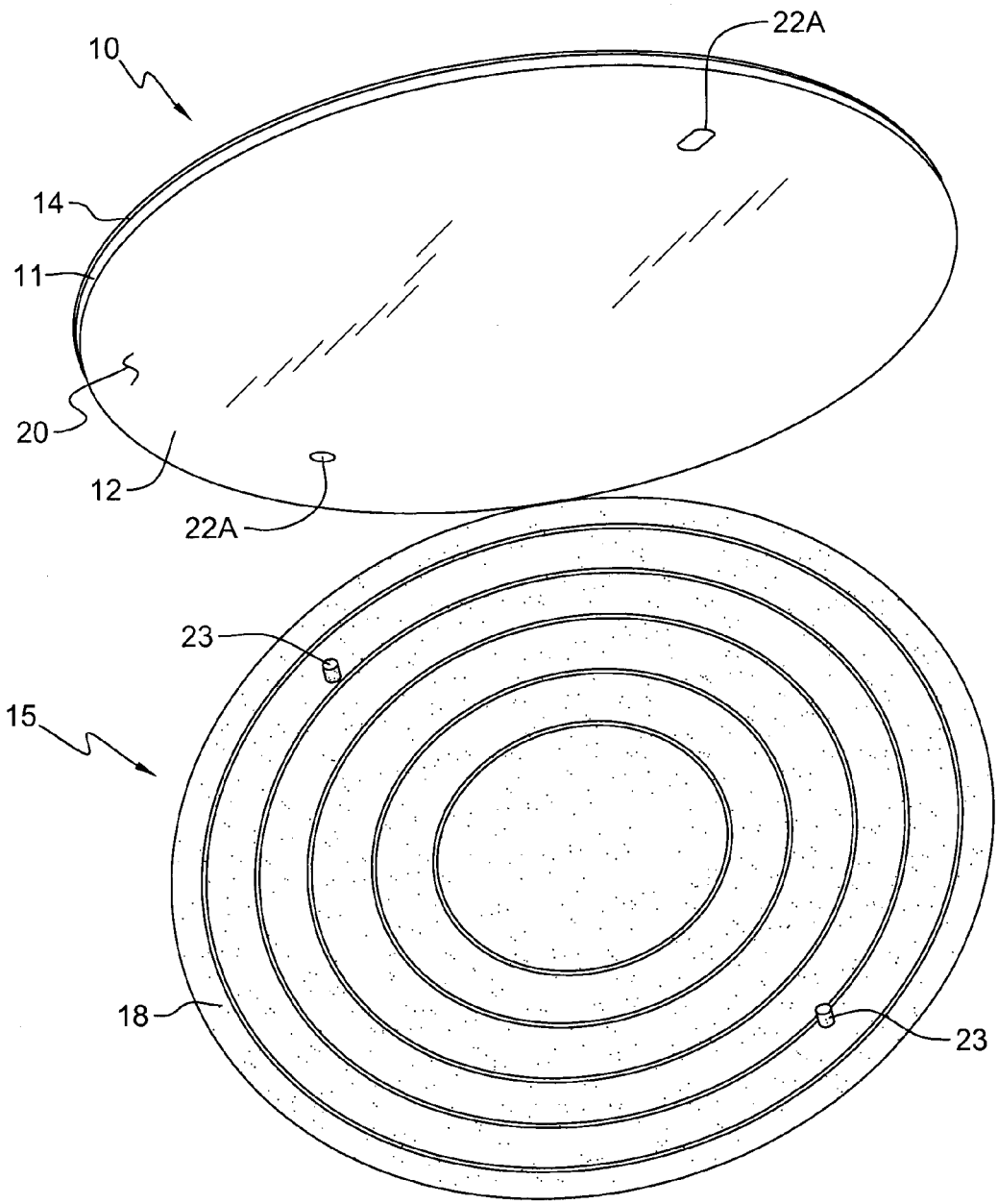
FIG. 1 is a perspective view of a first exemplary embodiment of a pottery holding device of the present invention showing the bottom surface of an exemplary wheelhead member being placed on an exemplary pottery wheelhead.

In FIGS. 1-6, a pottery holding device assembly embodying a first embodiment of the present invention is indicated generally by the reference numeral 10. As shown in FIGS. 1-6, the pottery holding device 10 includes an exemplary wheelhead member 11 and at least four exemplary potter holding members 16. The wheelhead member 11 includes an exemplary bottom disc 12 and an exemplary top disc 14.

As shown in FIG. 1, the bottom disc 12 is preferably configured to be applied to the top surface of a wheelhead 18 of a pottery wheel, such as exemplary pottery wheel 15. As such, exemplary bottom disc 12 may include a planar exemplary wheelhead or bottom surface 20 sized and shaped comparable to the top surface of wheelheads. Because wheelhead sizes and shapes may differ in the marketplace, bottom disc 12 may be any size and shape that substantially corresponds to an existing wheelhead. For example, typical wheelheads are circular with diameters ranging from about 7 inches to about 16 inches, and more typically from about 12 inches to about 14 inches. Bottom disc 12 may therefore be circular with a diameter of between about 10 inches and about 26 inches, and more preferably about 16 inches. It is also noted that the bottom disc 12 maybe be larger, smaller or of a different shape than existing wheelhead designs. For example, with respect to exemplary wheelhead 18, bottom disc 12 may overhang at least one portion of the wheelhead 18, may be smaller than the wheelhead 18 in at least one direction, or may be non-circular.

Exemplary bottom disc 12 may be formed from any material, but preferably formed of a material that is capable of lying flat on the top surface of a wheelhead 18 and providing stability to the exemplary pottery holding device 10. However, in alternative embodiments, the bottom disc 12 may be soft or pliable and not provide stability to the pottery holding device 10, but rather stability may be provided by other aspects of the pottery holding device 10. The thickness of the bottom disc 12 may depend upon the material properties of the bottom disc 12, but preferably the bottom disc 12 is relatively thin, such as less than about 1 inch, and more preferably less than about 0.75 inches. In the illustrative embodiment shown in FIG. 1, the bottom disc 12 is about 5/16 inches thick. For example, bottom disc 12 may be formed of a single relatively thin piece of wood, plastic, metal, or may be formed of combinations of materials, such as layers of wood, fiberglass or carbon fiber. In the illustrative embodiment shown in FIG. 1, the bottom disc is comprised of a single piece of a plastic. The bottom surface 20 of bottom disc 12 may or may not include a surface texture thereon. In the illustrate embodiment, the exemplary bottom disc 12 (and the exemplary wheelhead member 11) overhangs the exemplary wheelhead 18 about the periphery of the exemplary wheelhead 18.

As also shown in FIGS. 1-4 and 6, bottom disc 12 may include one or more pin apertures 22A. In the illustrated embodiment, two pin apertures 22A are provided and extend linearly through the entirety of the thickness of the of the bottom disc 12 normal to the wheelhead or bottom surface 20, as shown best in FIG. 1. However, the pin apertures 22A may extend only partially through the thickness of bottom disc 12. Pin apertures 22A are preferably designed and configured to correspond to the bat pins of typical wheelheads, such as the exemplary bat pins 23 of the exemplary wheelhead 18, to locate and further secure the bottom disc 12 and exemplary pottery holding device 10 onto a wheelhead. For example, with circular bottom discs and wheelheads, such as the illustrated bottom disc 12 and wheelhead 18, the pin apertures 22A may designed and configured to substantially center the bottom disc 12 to the wheelhead 18. As such, two pin apertures 22A may be provided along a diameter of the bottom disc 12 and spaced typically about 5 inches from the center of the of the bottom disc 12 (i.e., an about 10 inch distance from center to center of the apertures). Because the size of the bottom disc may vary, the distance between the pin apertures 22A and the outer edge of the bottom disc may vary. Further, the size, shape and orientation of the pin apertures 22A may be any size or shape that is capable of accepting common bat pin sizes and shapes therein. For example, the exemplary wheelhead 18 shown in FIGS. 1-4 and 6 includes two circular pins 23 of a diameter of about 3/8 inches diametrically opposed along a diameter of the wheelhead 18, and extending vertically about inches 1/4 inches from the top surface of the wheelhead 18. Correspondingly, the pin apertures 22A in the bottom disc 12 are diametrically opposed along a diameter of the bottom disc 12, include a diameter of at least about 3/8 inches, and extend through the thickness of the bottom disc normal to the wheelhead surface 20. However, as shown in FIGS. 1-4 and 6 the pin apertures 22A may be sized, shaped and oriented differently, such as including one circular aperture and one oval aperture or slot. In such a configuration, the oval aperture or slot may allow for variations in bat pin 23 locations and/or sizes on differing wheelheads, while the circular aperture may provide a fully secure connection between the bottom disc 12 and pottery holding device 10 to the wheelhead 18.

As illustrated in FIGS. 1-4 and 6, the top surface of the exemplary bottom disc 12 is coupled to the bottom surface of the exemplary top disc 14 to makeup the wheelhead member 11. The top disc 14 and bottom disc 12 may be coupled to each other in any know method, such as glued, nailed, bolted, riveted, press-fit, taped or the like. In the illustrated embodiment, the bottom disc 12 is glued to the bottom disc 12 via a spray adhesive. The top surface 26 of the top disc 14 may form the working surface of the wheelhead member 11 and the pottery holding device 10.

In the illustrated embodiment, the top disc 14 substantially corresponds in shape, size and configuration to that of bottom disc 12. The potential variations to the size, shape and configuration of the bottom disc 12 discussed above equally apply to potential variations of the top disc 14. Exemplary Top disc 14 also includes pin apertures 22B that correspond to the pin tapertures 22A of the bottom disc. The potential variations of size, shape and configuration of the pin apertures 22A of the bottom disc 12 discussed above equally apply to potential variations to the pin apertures 22B of the top disc 14. In this way, the wheelhead member 11 (the combination of top disc 14 and bottom disc 12) preferably defines a disc shape with uniform edges and pin apertures 22A, 22B extending therethrough. However, the top disc 14 and the bottom disc 12, as well as the pin apertures 22A, 22B, may be of differing sizes, shapes and configurations, and therefore the wheelhead member 11 may not form a disc shape.

Figure 2:
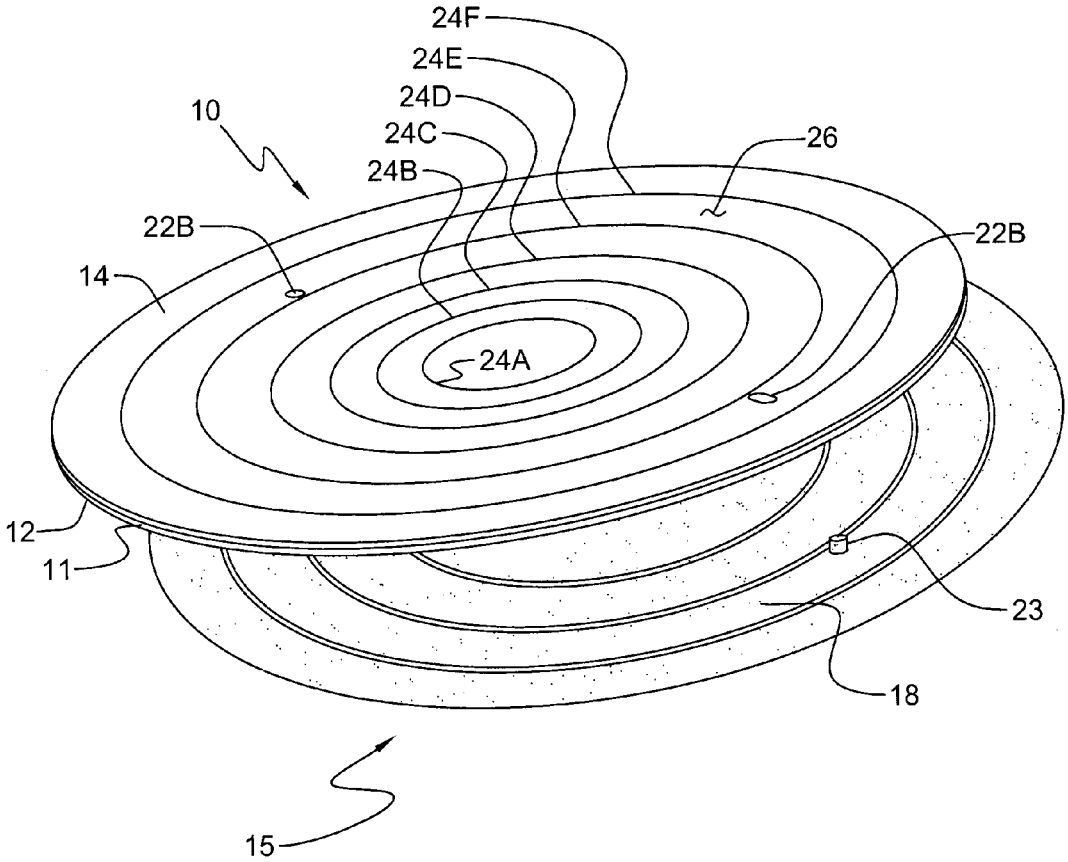
FIG. 2 is a perspective view of the first exemplary embodiment of the pottery holding device of FIG. 1 showing the top surface of the exemplary wheelhead member as it is being placed on the exemplary pottery wheelhead of FIG. 1.

As best shown in FIGS. 1 and 2, the thickness of top disc 14 may be less than the thickness of bottom disc 12. However, in alternative embodiments the thickness of top disc 14 may be equal to, or greater than, the thickness of bottom disc 12. In some embodiments, the thickness of the wheelhead member 11 (the combination of top disc 14 and bottom disc 12) is about ⅜ inches when wheelhead member 11 defines a diameter less than about 24 inches, and includes less than about 9/10 inch diameter when the diameter of is about 24 inches or greater.

In some embodiments, the top disc 14 is made from a magnetic material, such as a magnetic metal. In the illustrated embodiment, the top disc 14 is made from sheet steel and at least the working surface 26 has been coated with a light-colored substrate, such as a white powder coat, as shown in FIGS. 2-4 and 6. In an alternative embodiment, the bottom disc 12 is made from a magnetic material and the top disc 14 is made from a material that allows the magnetism of the bottom disc 12 to pass through, at least partially, the top disc 14. In yet another alternative embodiment, the wheelhead member 11 is a unitary structure made from a single piece of magnetic material.

As also shown in FIGS. 2-4 and 6, concentric reference circles or markings 24A-F may be provided on the working surface 26 of the top disc 14 and wheelhead member 11 about its center, and therefore about the center of the holding device 10. In the illustrated embodiment, the first reference circle 24A closest to the center of the top disc 14 has a diameter of about 3 inches. The next reference circle 24B towards the outer edge of the top disc 14, which is concentric about the first reference circle 24A, is spaced about 1 inch from the first circle 24A. The remaining concentric reference circles 24C, 24D, 24E and 24F emanate from the first and second reference circles 24A, 24B toward the outer edge of the top disc 14 and are spaced about 1 inch from one another. Concentric reference circles or markings 24A-F advantageously provide reference lines to aid a potter in centering, or off-centering, a workpiece 30 on the pottery holding device 10, and thus the wheelhead 18. Stated differently, the reference circles or markings 24A-F provide a quick and easily understood reference to a potter regarding the relative position of a workpiece 30 with respect to the axis of rotation and center of the holding device 10 and wheelhead 18.

Figure 3:
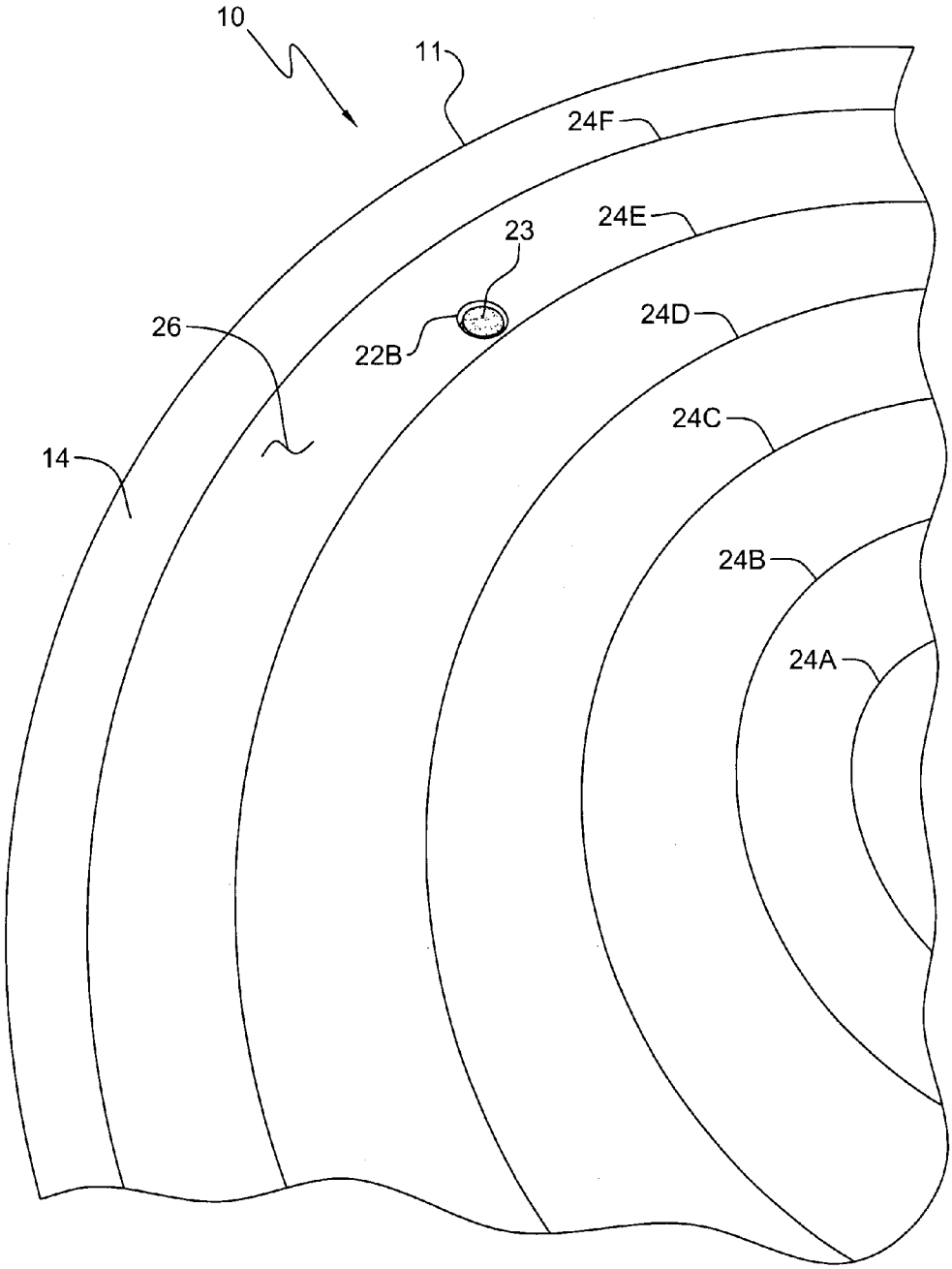
FIG. 3 is a perspective view of the top surface of the exemplary pottery wheelhead member of FIG. 1.

FIGS. 1-3 show sequentially the placement of the exemplary wheelhead member 11 of the exemplary pottery holding device 10 on a wheelhead 18. As shown in FIG. 1, the wheelhead or bottom surface 20 of the bottom disc 12 is placed in contact with the upper surface of the wheelhead 18. Then, the bin pins 23 are preferably aligned as best as possible with the pin apertures 22A of the bottom disc 12. As shown if FIG. 2, the pottery holding device 10 is then further lowered on the wheelhead 18. The pottery holding device 10 may be wiggled or shifted slightly to ensure the bin pins 23 are mated with pin apertures 22A. As shown in FIG. 3, when the pottery holding device 10 is fully lowered onto the wheelhead 18, the device 10 is fully seated on the top surface of the wheelhead 18 and the bin pins 23 are mated with the pin apertures 22A of the bottom disc 12 and are at least visible through the pin apertures 22B of the top disc 14. At this stage, a potter can look through the pin apertures 22B of the top disc 14 to ensure the device 10 is properly seated on the wheelhead 18 and the bin pins 23 are mated within at least the pin apertures 22A of the bottom disc 12. Depending upon the length of the bin pins of the particular wheelhead 18, the bin pins 23 may protrude, at least partially, through the pin apertures 22B of the top disc 14.

Figure 4:
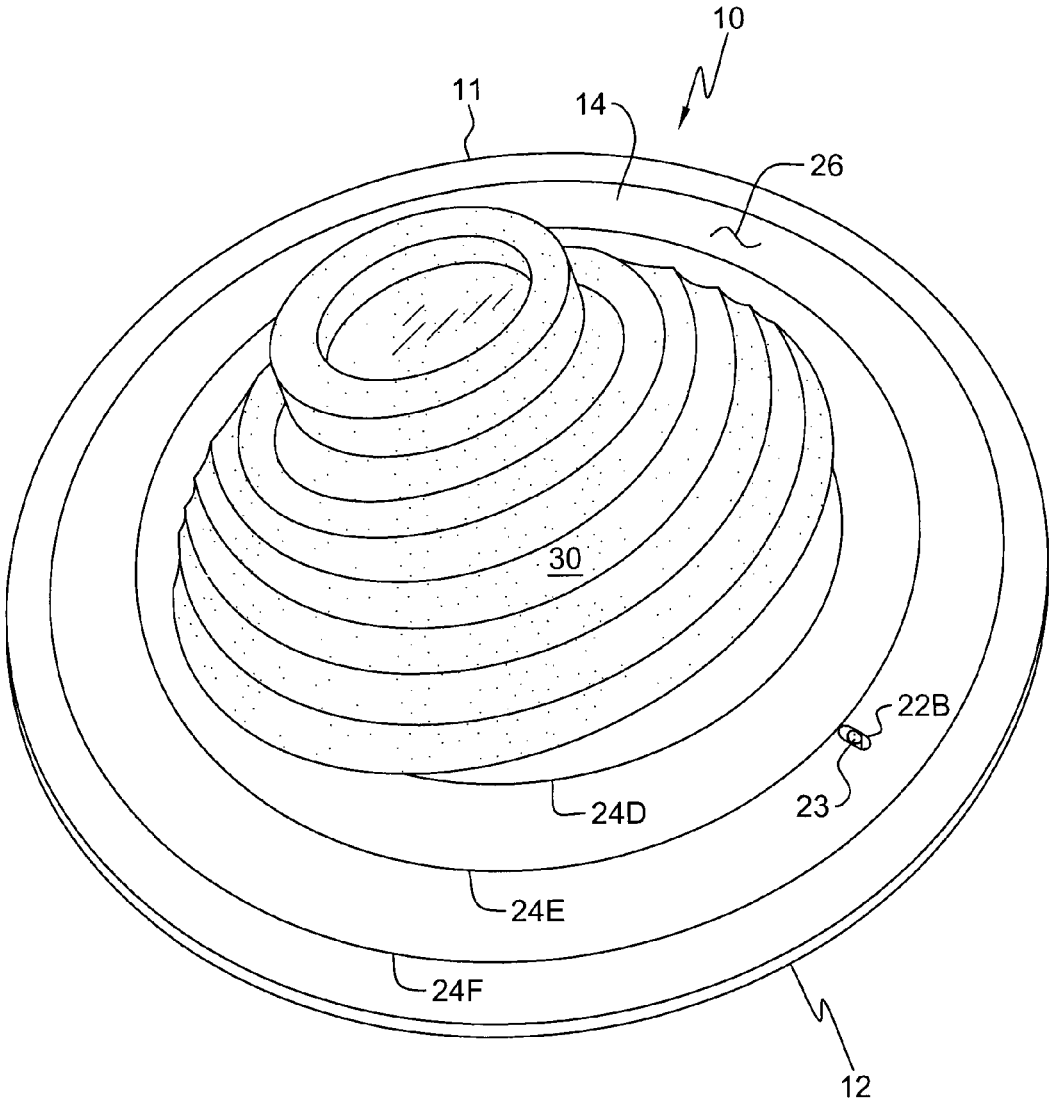
FIG. 4 is a perspective view of an exemplary workpiece being positioned on the top surface of the exemplary pottery wheelhead member of FIG. 1.
Figure 6:
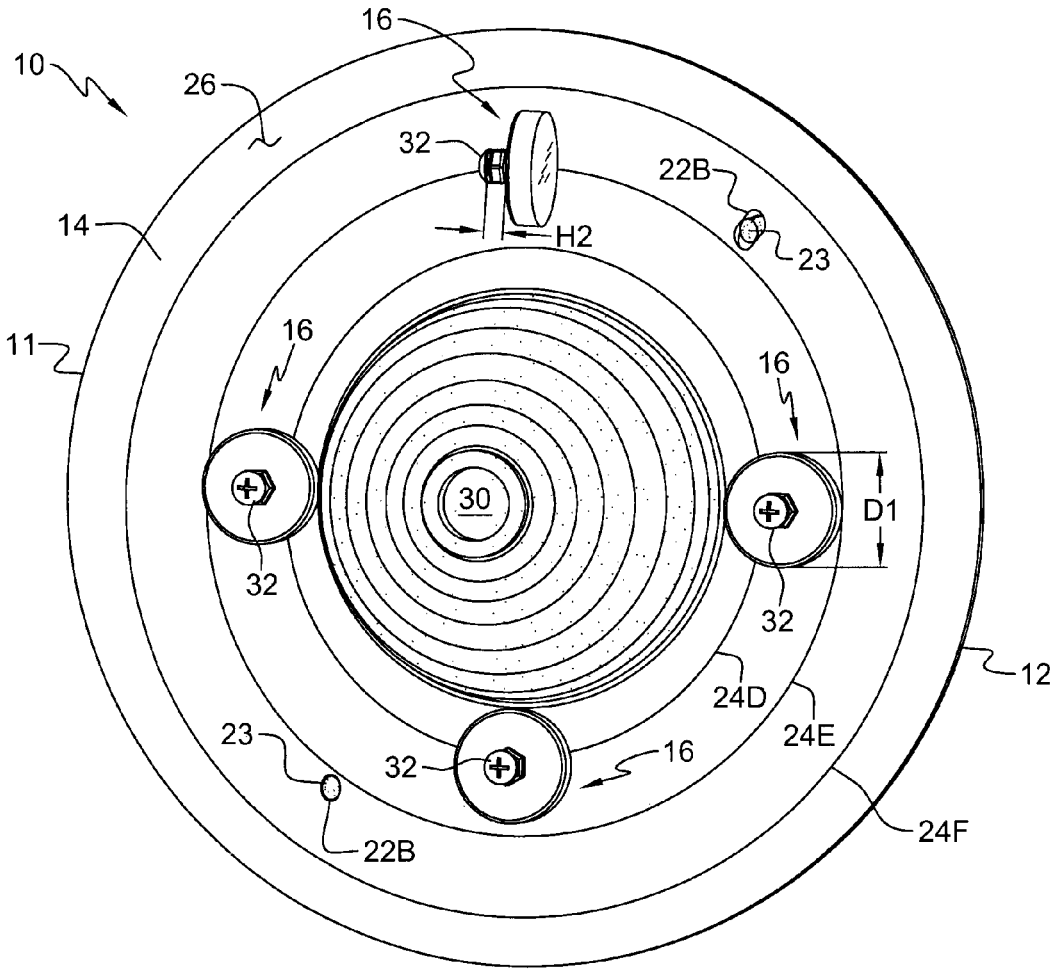
FIG. 6 is a top elevational view of the exemplary holding members of FIG. 5 securing the exemplary workpiece of FIG. 4 to the top surface of the exemplary wheelhead member.

Once the device 10 is properly seated on the wheelhead 18 of a pottery wheel 16, a workpiece 30 can be applied to the exemplary working surface 26 of the exemplary device 10, as illustrated in FIGS. 4 and 6. As the working surface 26 of the device 10 is void, the workpiece 30 can be applied anywhere on the working surface 26 with respect to the center of the device 10 and the axis of rotation. For example, the workpiece 30 can be placed off-center, or the workpiece 30 can be substantially centered as shown in FIG. 6. Although exemplary workpiece 30 is shown as substantially circular, because the working surface 26 is void any circular, non-circular symmetric and irregular or organic workpieces can be placed anywhere within the working surface 26 and secured in that specific location and orientation by holding members 16, as described below.

Figure 5:
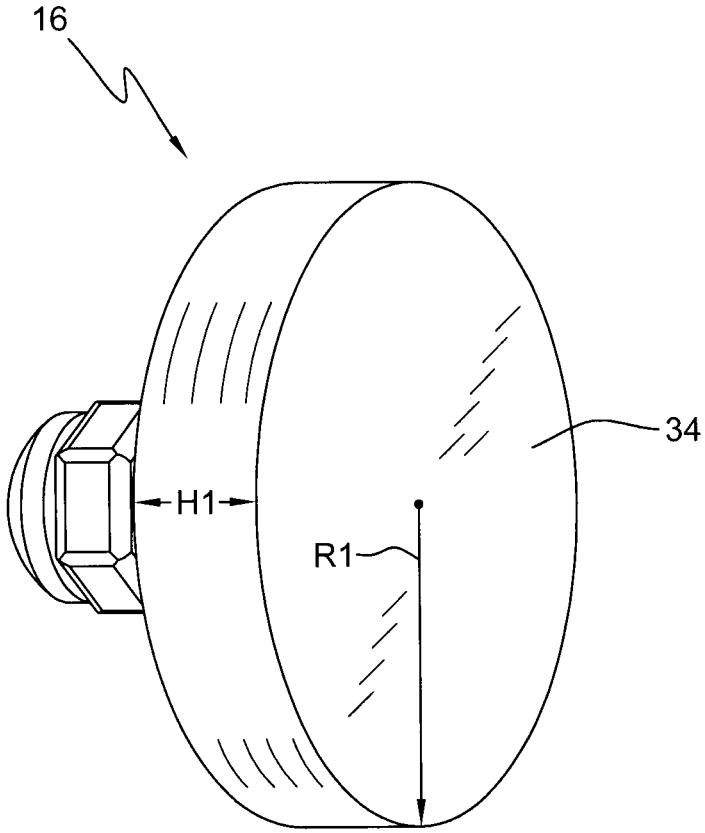
FIG. 5 is a perspective view of the bottom surface of an exemplary pottery holding member of the first exemplary embodiment of the pottery holding device of the present invention.

As shown in FIGS. 5 and 6, the exemplary at least three holding members 16 define a disc-like shape with a protrusion 32 disposed on the top surface of the members 16. The holding members 16 may be made from any material, but are preferably magnetized or include at least one magnetized member, such that the holding members 16 and the magnetic top disc 14 are attracted to one another. The bottom surface of the holding members 16 may include a non-slip surface, such as exemplary non-slip member 34 illustrated in FIG. 5. The non-slip member 34 may act to increase the friction between the holding members 16 and the top surface 26 of the device 10. The non-slip member 34 may also provide a surface that tends to not mark, scratch, chip or otherwise mar the working surface 26. For example, the non-slip member 34 may be a plastic, wax-coated paper, silicone or silicone-like material, rubber, or other material known in the art that is capable of exhibiting non-slip and protective properties, or combinations thereof. In the illustrative embodiment shown in FIG. 5, the non-slip member 34 is a silicone based material. In an alternative embodiment, the working surface 26 may include a non-slip material instead of, or in addition to, the non-slip member 34 of the holding members 16.

When the holding members 16 are applied to the wheelhead member 11, the combination of the frictional force and the magnetic attraction force between the holding members 16 and the top disc 14 of the wheelhead member 11 should be sufficiently strong to securely hold a workpiece 30 positioned between the holding members 16 during rotation of the device 10. When the holding members 16 are applied to the working surface 26 such that the forces between the holding members 16 and the wheelhead member 11 resists forces acting to translate and disengage the holding members 16 about the working surface 26, the holding members 16 can be said to be selectively locked with respect to the wheelhead member 11.

The flexible nature of the placement and movement of the holding members 16, facilitated by the magnetic attraction between the top disc 14 and the holding members 16, may lend itself to use with asymmetric or organic forms because the holding members 16 can be easily added, removed and repositioned about the device 10 to provide adequate support to a particular asymmetric or organic form in any location on the device 10. For example, the holding members 16 can be applied to the working surface 26 and positioned such that they abut at least three separate and distinct points of the workpiece 30 to securely hold the workpiece to substantially maintain the position and orientation of the workpiece 10 during rotation of the wheelhead 18 and device 10. Similarly, the holding members 16 can be applied to the working surface 26 such that they are spaced from the workpiece 30, or removed from the wheelhead member altogether, so that the workpiece 30 can be placed on, or removed from, the working surface 26 of the wheelhead member 11. In this way, the device 10 can be infinitely adapted to hold workpieces 30 of different shapes and sizes about the entire working surface 26 of the device 10.

In embodiments including at least four holding members 16, for example, the holding members 16 can be applied to the working surface 26 and positioned such that they abut at least four separate and distinct points of the workpiece 30 to securely hold the workpiece to substantially maintain the position and orientation of the workpiece 10 during rotation of the wheelhead 18 and device 10. Such embodiments may be particularly advantageous for some four-sided, non-symmetrical and organic shaped workpieces.

The size and shape of the holding members 16 may be of any size and shape. The only requirements to the size and shape of the holding members 16 is that they are manually engageable and of a sufficient size and shape to support, secure or otherwise resist movement of a workpiece 30 when the workpiece 30 is placed on the working surface 26 and the device 10 is rotated with the wheelhead 18. In the illustrated embodiment shown in FIGS. 5 and 6, the holding members 16 are generally of a disc shape defining a radius R1 of about 0.86 inches and a first height H1 of about 0.3 inches. The junction of the lateral side edges and the top and bottom surfaces of the holding members 16 may be rounded to prevent scratching or marring of the working surface 26 and a workpiece 30. The lateral side edges that extend between the top and bottom surfaces of the holding members 16 may themselves be rounded or curved so that they typically provide a point of tangency with a workpiece 30 placed in abutment with the holding members 16. It is noted that the disc shape of the illustrated holding members 16 allows the holding members 16 to be placed in any orientation on the working surface 26 (the symmetrical profile allows a potter to ignore the orientation of the holding members 16). The rounded profile of the disc-shaped holding members also provides a single, smooth point or points of contact with most workpieces 30 (disc-shaped holding members 16 sit tangent to most workpieces 30). By placing the at least four holding members 16 in abutment about the outer surface of a workpiece 30, the holding members 16 provide at least three, or at least four, opposing points of contact to securely hold the workpiece 30 in a particular position and orientation on the working surface 26 as the device 10 rotates with the wheelhead 18, depending upon how may holding members 16 are provided. The size and shape of a particular workpiece 30 may dictate the number of holding members 16 used and their exact placement or arrangement about the workpiece 30.

As shown best in FIG. 6, when at least four holding members 16 are provided, the at least four holding members 16 may include a protrusion 32 disposed on the top surface of the members 16. Protrusion 32 may be integral with other aspects of the holding members 16, or may alternatively be fixed or selectively fixed to aspects of the holding members 16. Protrusion 32 may be any size and shape, but it is preferred that protrusion 32 be of a size and shape that can be manually engaged by a potter's finger or fingers. In the illustrated embodiment, protrusion 32 is a bolt and nut in threaded engagement with a disc-shaped lower portion extending to a height H1 of about 0.375 inches from the lower portion. Protrusion 32 aids in the placement, removal and adjustment of the holding members 16 on the working surface 26. For example, if a holding member 16 is placed on the working surface 26 spaced from an outer surface of a workpiece 30, a potter can manually apply force to protrusion 32 to overcome the magnetic and frictional forces between the holding member 16 and the top disc 14 and working surface 26, respectively, to slide the holding member 16 into abutment with the workpiece 30. After the workpiece 30 has been rotated and worked, such as a foot trimmed into an asymmetric or organic form, a potter can manually engage the protrusion 32 to slide the holding member 16 away from the workpiece 30 and/or remove the holding member 16 from the working surface 26 of the device 10.

Figure 7:
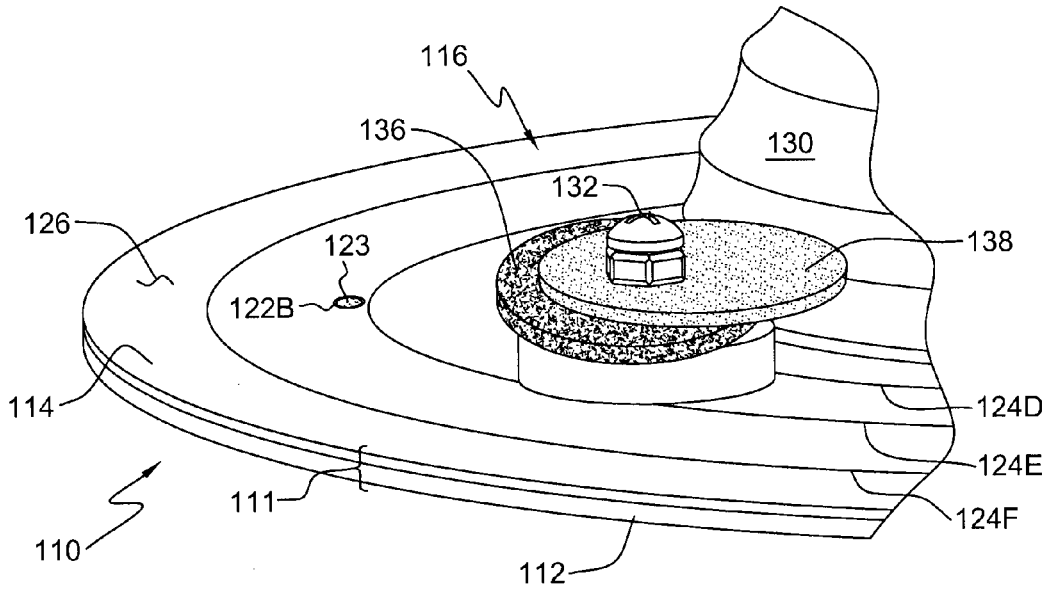
FIG. 7 is a perspective view of a second exemplary embodiment of a pottery holding device of the present invention showing an alternative exemplary holding member.

In FIG. 7, another exemplary pottery holding device embodying a second embodiment of the present invention is indicated generally by the reference numeral 110. The exemplary pottery holding device 110 is substantially the same as the exemplary pottery holding device 10 described above with reference to FIGS. 1-6, and therefore like reference numerals preceded by the numeral "1" are used to indicate like elements. The bottom disc 112 and top disc 114 of the wheelhead member 111 of the pottery holding device 110 are the same as the pottery holding device 10, and therefore the illustrations of FIGS. 1-6 and the associated detailed description of the bottom disc 12 and top disc 14 equally apply to the pottery holding device 110 of FIG. 4. The exemplary pottery holding device 110 differs from the exemplary pottery holding device 10 with respect to the configuration of the holding members 116. In pottery holding device 110, the exemplary at least three holding members 116 (four holding members 116 illustrated) include an exemplary flexible member 136 disposed on the upper surface of the holding members 116 and about the protrusion 132, and an exemplary lever member 138 disposed on the upper surface of the flexible member 136 and about the protrusion 132.

As shown in FIG. 7, the exemplary flexible member 136 is at least partially disposed on the lateral sides of the holding members 116, as well as the top surface of the holding members 116. In one embodiment, the flexible member 136 is preferably made from a material that deforms over the lateral sides of the holding member 116 as the top surface of the flexible member 136 is compressed. In one such embodiment, the flexible members deforms over the lateral sides of the holding member 116 and increases density as a result of such deformation. The flexible member 136 may be made from any material that is capable of flexing as a result of forces between the holding members 116 and a workpiece 130. In one embodiment, it is preferred that the flexible member 136 provide cushioning between the holding members 116 and a workpiece 130 to prevent scratching or marring of the workpiece 130, but none-the-less provide adequate forces to the workpiece 130 to secure the workpiece 130 during rotation and trimming or other pottery processes. In the illustrated embodiment shown in FIG. 7, the flexible member 136 is foam.

As also shown in FIG. 7, an exemplary lever member 138 may be at least partially disposed about the protrusion 132 and extend past a lateral side edge of the holding members 116. Exemplary lever member 138 may be any size and shape, but it is preferred that the lever member 138 extend past a side edge of the holding members 116 a distance that allows for a potter to manually engage the underside of the lever member 138 with at least one finger and apply force thereon. In the illustrated lever member 136 shown in FIG. 7, the lever member 138 extends about ½ inch beyond the lateral side edge of the holding members 116. The lever member 138 may also be relatively stiff such that it substantially resists force applied thereon by a potter to move or remove the holding members 116 from the device 110. Some level of flexibility may not interfere with the lever members 138 functioning as levers capable of being engaged to move, or remove, the holding members 116 about the device 110. The lever members 138 may facilitate release of the holding members 116 and aid in the accuracy of both the initial placement of the holding members 116 and adjustment thereof during use, thereby quickly and accurately securing a workpiece 130 to the device 110.

In FIGS. 8-14, another exemplary pottery holding device embodying a third embodiment of the present invention is indicated generally by the reference numeral 210. Exemplary pottery holding device 210 includes an exemplary wheelhead member 212 and at least three exemplary pottery holding members 214 disposed on the wheelhead member 212. In the illustrated embodiment, the exemplary illustrated potter holding device 210 includes four exemplary pottery holding members 214 disposed on the wheelhead member 212. However, less than three and more than four exemplary pottery holding members 214 may be provided.

Figure 8:
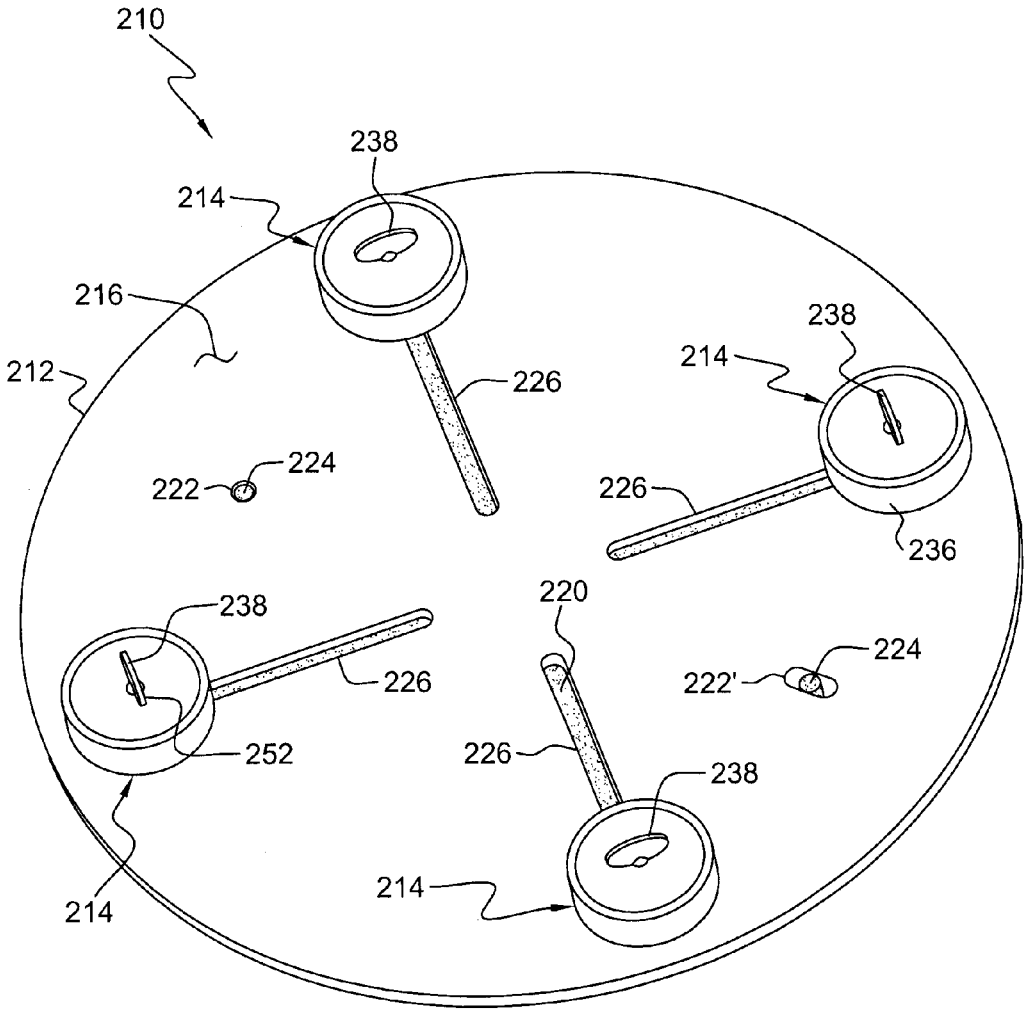
FIG. 8 is a perspective view showing the top surface of a third exemplary embodiment of a pottery holding device of the present invention applied to a wheelhead of an exemplary pottery wheel.
Figure 9:
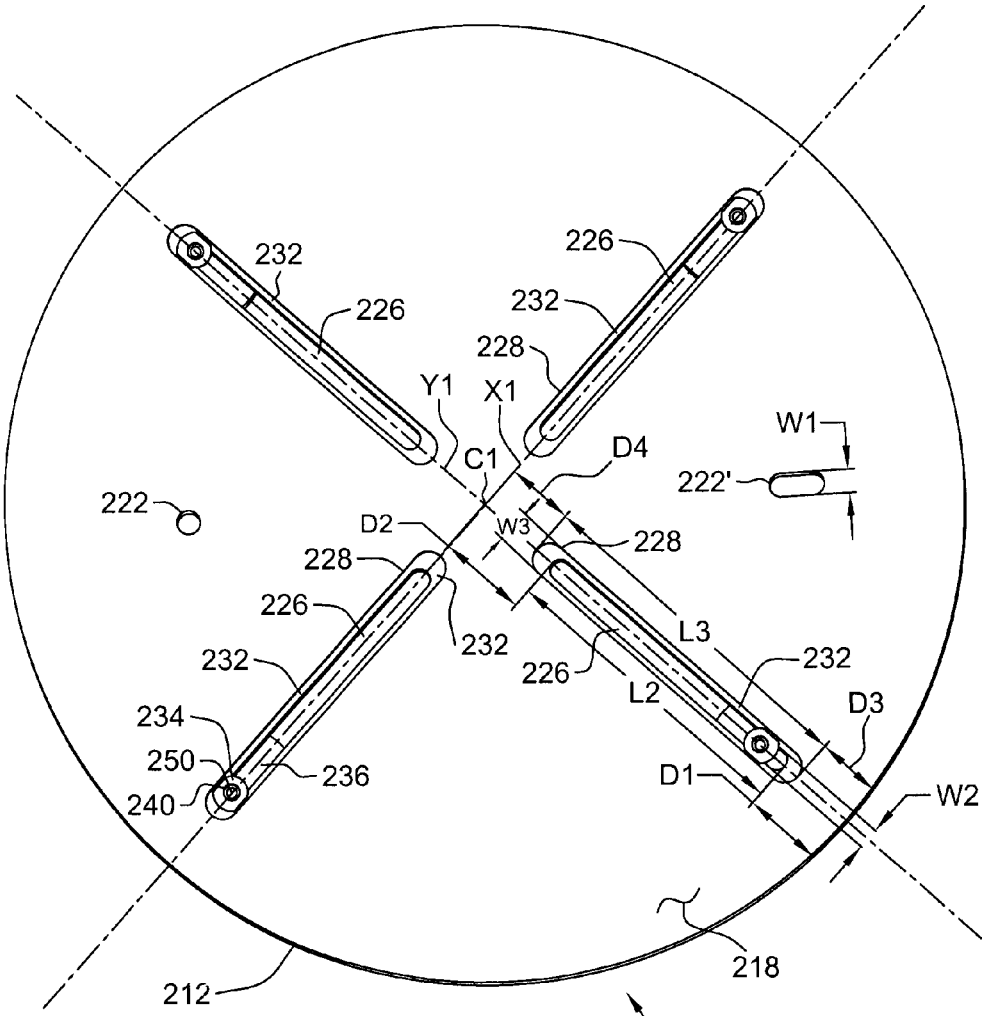
FIG. 9 is a perspective view of the third exemplary embodiment of the pottery holding device of FIG. 8 showing the bottom surface of the device.
Figure 10:
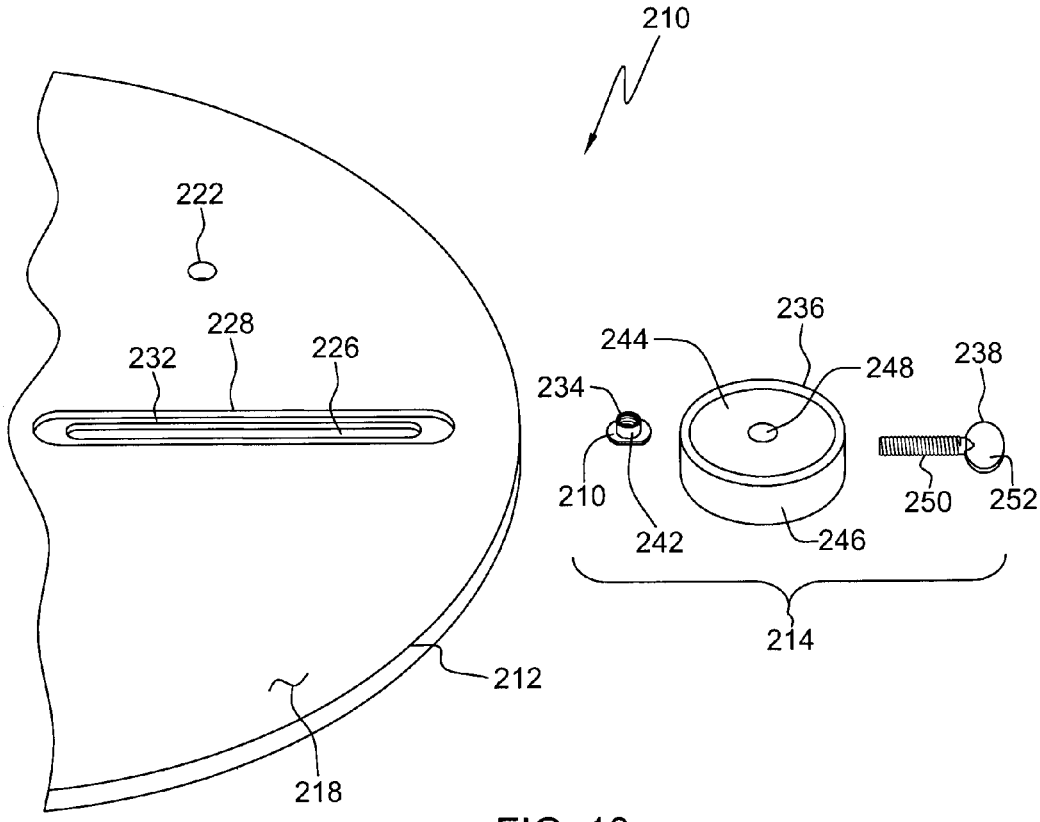
FIG. 10 is a perspective view of the third exemplary embodiment of the pottery holding device of FIG. 8 showing the bottom surface of the device and the holding members of the device in an unassembled state.

As shown in FIGS. 8 and 11-14, the top surface of the wheelhead member 212 defines an exemplary working surface 216, and as shown in FIGS. 9 and 10, the bottom surface of the wheelhead member 212 defines an exemplary wheelhead surface 218. The wheelhead member 212 is preferably configured to be applied to the top surface of a wheelhead 220 of a pottery wheel, as shown in FIGS. 8 and 12-14. As such, the wheelhead surface 218 may define a planar surface so that the wheelhead member 312 and the pottery holding device 310 will sit level and in tight abutment with a wheelhead 220. The wheelhead member 212 is also sized and shaped comparable to the top surface of typical wheelheads. Because wheelhead sizes and shapes may differ in the marketplace, wheelhead member 212 may be any size and shape that substantially corresponds, or is compatible to, an existing wheelhead 220. For example, some typical wheelheads include a circular upper surface with diameters ranging from about 10 inches to about 14 inches. Wheelhead member 212 may therefore be circular with a diameter of between about 10 inches and about 24 inches, and preferably between 15 inches and 24 inches. The wheelhead member 212 may be larger, smaller or of a different shape than existing wheelhead designs. For example, the wheelhead member 212 may define a disc shape that is larger than a wheelhead 220 such that an outer portion of the wheelhead member 212 overhangs the wheelhead 220.

Exemplary wheelhead member 212 may be formed from any material, but preferably formed of a material that is capable of lying flat on the top surface of a wheelhead 220 and providing stability to the exemplary pottery holding device 210. However, in alternative embodiments, the wheelhead member 212 may be soft or pliable and not provide stability to the pottery holding device 210, but rather such stability may be provided by other aspects of the pottery holding device 210. The thickness of the wheelhead member 212 may depend upon the material of the wheelhead member 212, but preferably the wheelhead member 212 is relatively thin, such as less than about 0.375 inch, and more preferably less than about ½ inches. In the illustrative embodiment shown in FIGS. 8-14, the wheelhead member 212 is about ¼ inches thick. For example, wheelhead member 212 may be formed of a single relatively thin piece of wood, plastic, metal, or may be formed of combinations of materials, such as layers of wood or plastics, fiberglass or carbon fiber. In the illustrative embodiment shown in FIGS. 8-14, the wheelhead member 212 is comprised of a single piece of plastic.

The wheelhead or bottom surface 218 of wheelhead member 212 may include a surface texture that provides an amount of friction with the top surface of the wheelhead 220 that aids in securing the exemplary pottery holding device 210 to the wheelhead 220 during rotation of the wheelhead 220. Such friction may aid in preventing the pottery holding device 210 from sliding about the wheelhead 220, as well as preventing twisting or other movement in reaction to the rotational force exerted by the wheelhead 220. The surface texture of wheelhead surface 218 may be natural to the material comprising the wheelhead member 212, or may be machined or applied to the wheelhead member 212. For example, the wheelhead surface 218 of the wheelhead member 212 may be sanded or deformed, or a mild adhesive may applied thereto, to increase the surface friction between the wheelhead 220 and the wheelhead member 212 above what the natural finish of the wheelhead surface 218 would have provided if it were not treated.

As also shown in FIGS. 8-14, wheelhead member 212 may include one or more pin apertures 222, 222'. In the illustrated embodiment, two pin apertures 222, 222' are provided and extend linearly through the entirety of the thickness of the wheelhead member 212 normal to the wheelhead surface 218. However, it is contemplated that the pin apertures 222, 222' may extend only partially through the thickness of wheelhead member 212. Pin apertures 222, 222' are preferably designed and configured to correspond to the bat pins of typical wheelheads, such as the bat pins 224 of exemplary wheelhead 220 as shown in FIGS. 8 and 12-14, to locate and further secure the wheelhead member 212 and exemplary pottery holding device 210 onto a wheelhead 220. As such, two pin apertures 222, 222' may be provided along a diameter of the wheelhead member 212 and spaced about 5 inches from the center of the of the wheelhead member 212. Because the size of the wheelhead member 212 may vary, the distance between the pin apertures 222, 222' and the outer edge of the wheelhead member 212 may vary. Further, the size, shape and orientation of the pin apertures 222, 222' may be any size or shape that is capable of accepting common bat pin sizes and shapes therein. For example, the exemplary wheelhead 220 shown in FIGS. 8 and 12-14 includes two circular bat pins 224 diametrically opposed along a diameter of the wheelhead 220, the bat pins 224 defining a diameter of about ⅜ inches, the center of the bat pins 224 being spaced about 10 inches from one another, and the bat pins 224 extending vertically about ¼ inches from the top surface of the wheelhead 220. Correspondingly, the pin apertures 222, 222' in the wheelhead member 212 are diametrically opposed along a diameter of the wheelhead member 212, the center of the pin apertures 222, 222' being spaced about 10 inches from one another, the width of the pin apertures 222, 222' being at least about ⅜ inches, and the apertures 222, 222' extending at least about ¼ inches through the thickness of the wheelhead member 212 from the wheelhead surface 218, and preferably through the entire thickness of the wheelhead member 212 to facilitate proper placement of the device 210.

The pin apertures 222, 222' may be sized, shaped, oriented or positioned differently from one another. In the illustrated embodiment shown in FIGS. 8-14, the wheelhead member 212 includes one exemplary circular pin aperture 222 and one exemplary slot aperture 222'. As shown best in FIGS. 8-12, the circular pin aperture 222 may substantially correspond to the size and shape of the circular pins 224 of the exemplary wheelhead 220, as described above. As such, the circular pin aperture 222 of the illustrated embodiment defines a width W1 of at least about ⅜ inches, as illustrated in FIG. 9. As shown best in FIGS. 8, 9, 11 and 14, the slot pin aperture 222' is oblong or extended along a diameter of the wheelhead member 212 intersecting with the circular pin aperture 222. The slot pin aperture 222' allows for slight variations in bat pin 224 size, shape and location. For example, if the bat pins 224 of the exemplary wheelhead 220 shown in FIGS. 8-14 were spaced from one another slightly more than the 10 inch spacing described above, such as about a 10.1 inch spacing, one bat pin 224 would be secured in the circular pin aperture 222 and the other bat pin 224 would be seated within the slot pin aperture 222' towards the portion of the slot pin aperture 222' that is adjacent the outer edge of the wheelhead member 212. As illustrated in FIG. 14, to allow for wheelheads with differing bat pin 224 spacing, the length L1 of the slot pin aperture 222' along a radius of the wheelhead member may be larger than the diameter of standard bat pins 224, but the first width W1 of the slot pin aperture 222' in the direction of rotation may be substantially similar to the diameter of standard bat pins 224. In such an arrangement, as can be seen in FIG. 8, the wheelhead 212 is firmly secured in the direction of rotation by both the bat pins 224 and both the bat pin apertures 222, 222', as well as firmly secured along a radius of the wheelhead member 212 by the circular bat pin aperture 222 and the bat pin 224 secured therein. In the illustrated embodiment shown in FIGS. 8-14, the diameter of the circular pin aperture 222 is about ⅜ inches, a first width W1 of the slot pin aperture 222' is about ⅜ inches, and a first length L1 of the slot pin aperture 222' is about ½ inches.

As shown in FIGS. 8-14, the wheelhead member 212 may include holding member slots 226 disposed radially about the device 210 corresponding to the number of holding members 216. As the illustrated embodiment includes four holding members 214, the wheelhead member 212 includes four slots 226. However, as discussed above, the wheelhead member 212 may include at least three holding members 216, and therefore the wheelhead member 212 may include at least three corresponding slots 226. In the illustrated embodiment, the exemplary holding member slots 226 are oblong and pass through the entirety of the wheelhead member 212. In an alternative embodiment, the holding member slots 226 do not pass through the entirety of the wheelhead member 212, but rather define recesses in the working surface 216 or wheelhead surface 218 of the wheelhead member 212. The holding member slots 226 may extend substantially normal through the wheelhead member with respect to the wheelhead surface 218 and working surface 216 (at least when the wheelhead surface 218 and working surface 216 are substantially planar and parallel with each other).

The holding member slots 226 may be configured to carry or otherwise allow movement of the holding members 214. To fully secure and hold a workpiece 230 with the holding members 214, the holding member slots 226 may be disposed radially equidistant from one another and from the center of the device. In such an embodiment including four holding members, as shown in the illustrated embodiment in FIGS. 9 and 11, the holding member slots 226 are thereby radially spaced 90 degrees from one another, with pairs of holding members 226 being aligned along two perpendicular diameters X1, Y1 of the wheelhead device 210 (the holding members 226 of each pair being spaced 180 degrees from one another). As can be seen from FIG. 11, the intersection of the perpendicular diameters X1, Y1 defined by the pairs of holding members 226 in such an embodiment is inherently aligned with the center C1 of the wheelhead member 212 and device 210.

Figure 11:
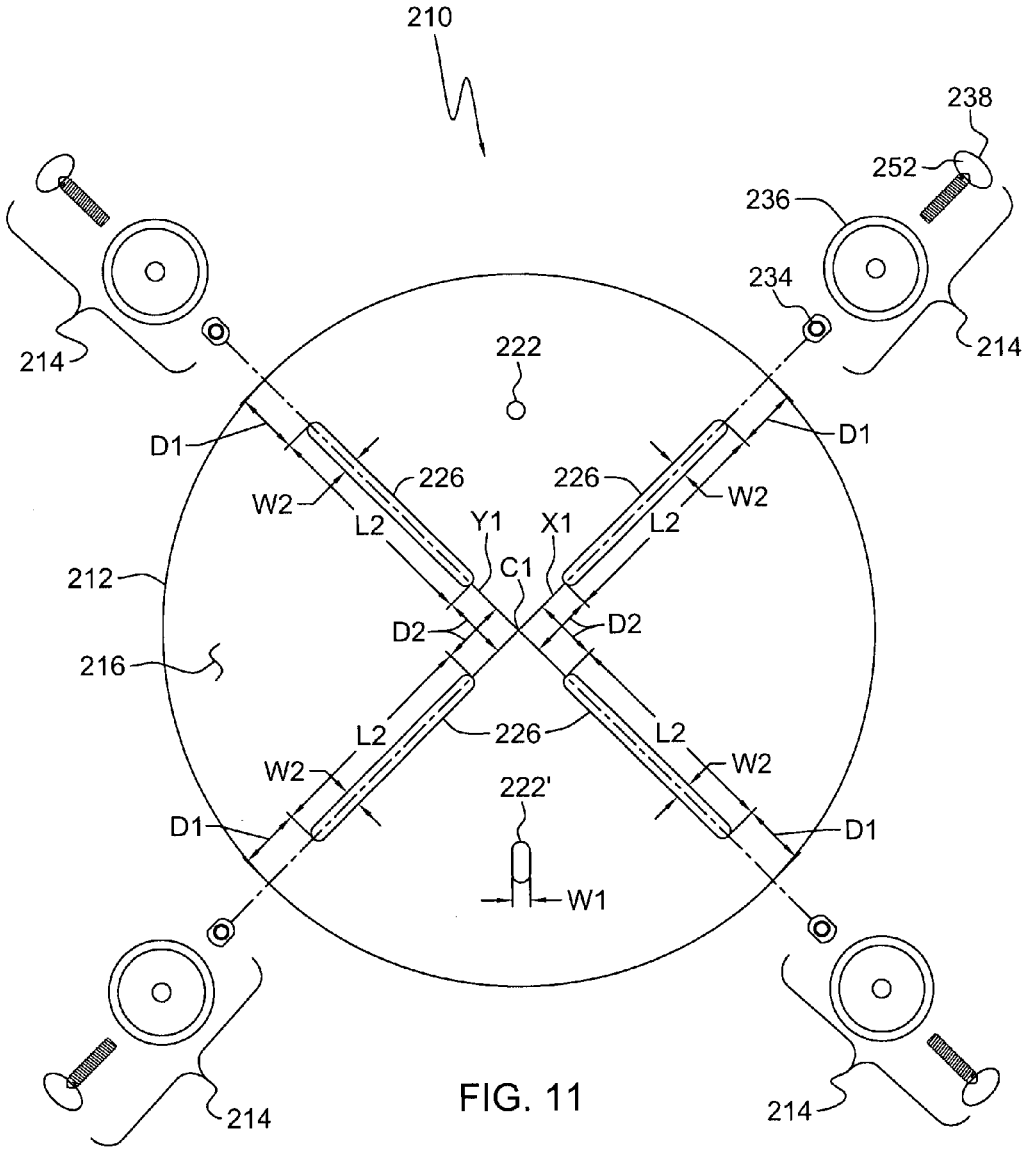
FIG. 11 is a perspective view of the third exemplary embodiment of the pottery holding device of FIG. 8 showing the top surface of the device and the holding members of the device in an unassembled state.

As described above, the holding member slots 226 may be substantially radially equidistant from one another, substantially equally spaced from the center of the wheelhead member 212, substantially equally spaced from the outer edge of the wheelhead member 212, and shaped and sized substantially the same. The holding member slots 226 may define substantially linear, elongated slots with parallel side walls extending from a portion of the wheelhead member 212 adjacent the outer edge to a portion of the wheelhead member 212 adjacent the center of the wheelhead member 212 along a diameter of the wheelhead member 212. As shown in the illustrated embodiment, and as indicated in FIGS. 9 and 11, the holding member slots 226 are spaced a first distance D1 of about ¾ inches from the outer edge of the wheelhead member 212, spaced a second distance D2 of about 2 inches from the center C1 of the wheelhead member 212, extend a second length L2 of about 10-½ inches along a radius of the wheelhead member 212, and define a linear slot of a second width W2 of about 5/16 inches. It is noted, however, that the particular location, orientation, length and width of the holding member slots 226 may vary to accommodate differing sized holding members 214, wheelheads 220 and/or workpieces 230.

The wheelhead surface 218 of the wheelhead member 212 may include recesses 228 extended into the wheelhead member 212 toward the working surface 216 about the holding member slots 226, as illustrated best in FIGS. 9 and 10. The recesses 228 may or may not define a shape that substantially corresponds to the shape of the holding member slots 226, and such shape may or may not be centered about the holding member slots 226. As shown in FIGS. 9 and 10, the recesses 228 may define a planar channel 232 that extends about the periphery of the holding member slots 226. In some embodiments, the width and length of the recesses 228 therefore may be larger than the second width W2 and the second length L2 of the holding member slots 226. In the illustrated embodiment, a third width W3 of the recesses 228 is about 9/16 inches, and a third length L3 of the recesses 228 is about 10.875 inches. In some embodiments, the depth of the recesses 228 is about ⅛ inches. In some other embodiments the depth of the recesses 228 is about 3/32 inches.

In some embodiments, the particular size and shape of the recesses 228 of the holding member slots 226 may be dependent upon a size and shape of a sliding member 234 of the exemplary holding members 214. As shown best in an unassembled state in FIG. 10, the holding members 214 may include an exemplary sliding member 234, an exemplary stop member 236 and an exemplary locking member 238.

FIG. 10 shows an exemplary holding member 214 in an unassembled state. As can be seen from FIG. 10, the exemplary sliding member 234 includes an exemplary flange member 240 and an exemplary internally threaded post member 242. In some embodiments, the flange member 240 may be of any size and shape that is capable of being received within the recesses 228. Conversely, the recesses 228 may be sized and shaped to receive the flange member 240 therein. In such embodiments that include the flange member 240 received within the recesses 228, the relative dimensions of the flange 240 and the recesses 228 may be configured to allow the flange member 240 to freely slide on the channel 232 of the recesses 228. Similarly, in some embodiments the post member 242 may be of any size and shape that is capable of being received within the holding member slots 226. Again, conversely, the holding member slots 226 may be sized and shaped to receive the post member 242 therein. In such embodiments that include the post member 242 received within the holding member slots 226, the relative dimensions of the post member 242 and the holding member slots 226 may be configured to allow the post member 242 to freely slide within the holding member slots 226.

As most clearly illustrated in FIG. 9, the flange member 240 and the recesses 228 are sized and shaped with respect to one another to allow the flange member 240 to be fully received within the planar channel 232 of the recesses 228. In some embodiments, the flange member 240 may define substantially elongated linear parallel side edges for mating with the linear side edges of the recesses 228. In such an embodiment, as illustrated in FIG. 9, when a sliding member 234 is received within a recess 228, the side edges of the flange member 240 may prevent the sliding member 234 from rotating within the recess 228. It is noted that in order to allow the flange member 240 to freely slide within the recesses 228, at least a relatively small gap must be provided between the side edges of the flange 240 and the side walls of the recesses 228, and thus a relatively small amount of rotation of the flange 240 will occur (i.e., the width of the flange member 240 must be less than the third width W3 of the recesses 228). For example, a 1/32 inch gap between the side edges of the flange member 228 and the side walls of the recesses 228 may be present (i.e., the width of the flange member 240 may be 1/16 inch less than the third width W3 of the recesses 228). In such embodiments, a relatively small amount of rotation of the flange 240 will occur, but to such a degree that will not interfere with the proper functioning of the holding members 214 and device 210, as long as full 360 degree rotation of the flange 228 and sliding member 234 is prevented.

As described above, in some embodiments the recesses 228 define a planar channel 232. In some such embodiments, the top surface of the flange member 234 (the surface adjacent the post member 242) is also planar so that the flange member 234 sits substantially flat in the channel 232 and at least a substantial amount of the top surface of the flange member 234 abuts the channel 232. In some such embodiments, the depth of the planar channel 232 and the thickness of the flange member 240 may be dependent upon each other such that the thickness of the flange member 240 is fully received in the recesses 228 (i.e., the flange member 240 does not extend past the wheelhead surface 218 of the of the wheelhead member 212). In such a configuration, the wheelhead member 212 is capable of coupling to the wheelhead 220 such that the wheelhead surface 218 is in substantially full abutment with the top surface of the wheelhead 220 while the sliding members 234 are received with the recesses 228, and the sliding members 234, and therefore the holding members 214, are able to slide freely along the holding member slots 226.

The width or diameter of the internally threaded post member 242 of the sliding members 234 and the second width W2 of the holding member slots 228 may be sized and shaped with respect to one another to allow the post member 242 to be received within the holding member slots 228 and slide freely therein. In order to allow the post member 242 to freely slide within the holding member slots 228, the width or diameter of the internally threaded post member 242 may be substantially equal to or less than the second width W2 of the holding member slots 228. The height or length of the internally threaded post member 242 measured from the top surface flange member 240 may be less, greater or equal to a thickness of the wheelhead member 212. In the illustrated embodiment, the height or length of the internally threaded post member 242 measured from the top surface flange member 240 is about equal to the thickness of the wheelhead member 212 measured from the channel 232 to the working surface 216. Therefore, in the illustrated embodiment the top of the post members 242 are substantially flush with the working surface 216.

In the illustrated embodiment, the post member 242 of the sliding member 234 of the pottery holding members 214 is internally threaded, as shown in FIG. 10. As best also shown in FIG. 10, the exemplary locking member 238 includes an externally threaded pin 250 configured to threadably engage the inner threads of the post member 242. As shown in FIGS. 8, 10 and 11, the locking member 238 may include a manually engageable element 252 to facilitate manual threading and unthreading of the locking member 238 with the sliding member 234 to load and unload the holding members 214, as described below.

An exemplary stop member 236 of the device 210 is shown in FIGS. 8, 9 and 12-14. As best shown in FIG. 10, the stop members 236 may define a substantially circular shape with substantially parallel planar top and bottom surfaces, and linear side walls extending substantially perpendicularly between the top and bottom surfaces. The particular size, shape and configuration of the stop members 236 may be any size, shape and configuration capable of interacting with an outer surface of a workpiece 230. In the illustrated embodiment, the stop members 236 are disc-shaped with a diameter of about 2 inches and a thickness of about 3/4 inches. The stop members 236 may include a core 244 and an abutment member 246 about the periphery of the core 244 defining the side walls of the stop member 236. The core 244 may provide rigidity or support to the stop member 236, while the abutment member 246 may provide a flexible or soft outer surface, at least relative to the core 244, to contact a workpiece 230 without scratching, denting or otherwise marring the surface of the workpiece 230.

As best shown in FIGS. 10 and 11, the core 244 of the stop members 236 of the holding member 214 may include an aperture 248 extending normally with respect to the top and bottom surface through the entirety of the thickness of the core 244. The size of the aperture 248 in the core 244 may depend upon the size and shape of the threaded pin 250 and manually engageable member 252. For example, in the illustrated embodiment, the aperture 248 in the core 244 is circular and defines a diameter greater than or equal to that of the pin 250, but less than a width of the manually engageable member 252. In such an arrangement, the locking member 238 is able to couple to the stop member 236 by traversing the core with the threaded pin 250 and abutting the engageable member 252 against at least the top surface of the core 244.

As illustrated in FIGS. 8 and 9, the holding members 214 can be selectively fixed to the wheelhead member 214 along their corresponding holding member slots 226 via the interaction of the engageable member 252, stop member 236 and the sliding member 234. In particular, a sliding member 234 can be positioned in a recess 228 such that the upper surface of the flange 240 abuts the channel 232 and the internally threaded post 242 extends into a corresponding holding member slot 226. The threaded post 250 of the locking member 238 can be inserted through the aperture 248 of the core 244 of the stop member 214 and rotated into threaded engagement with the internally threaded post 242 of the sliding member 234 by manually engaging and rotating the manually engageable member 252 of the locking member 238. When the locking member 238 first threadably engages the sliding member 234 (i.e., when axial translation between the locking member 238 and the sliding member 234 is first prevented by the threads), the holding member 214 is coupled within the slots 226 and can freely slide along the holding member slots 226, and thus can be said to be in a movably coupled state with respect to the wheelhead member 214, as the arrangement illustrated in FIGS. 8 and 9.

The degree to which the manually engageable member 252 is rotated will directly affect how freely the holding members 214 will slide along the holding member slots 226. In practicality, the holding members 214 will be movably coupled with respect to the wheelhead member 212 and device 210 as long as the holding members 214 can be manually slid along the holding member slots 226. Stated differently, in practicality the holding members 214 will be movably coupled with respect to the wheelhead member 212 and device 210 if the force between the holding members 214 and wheelhead member 212 is less than a degree that would prevent manually translation of the holding members 214 in the holding member slots 226.

From such a movably coupled state described above, the manually engageable member 252 of the locking member 238 can be engaged and further rotated so that the holding member 214 is selectively locked with respect to the wheelhead member 214. In the illustrated embodiment, further rotation of the locking member 238 will selectively lock the holding member 214 with respect to the wheelhead member 214 because as the locking member 238 is further advanced into the post 242 of the sliding member 234, the sliding member 234 and the manually engageable member 252 are drawn closer together. The sliding member 234 and the manually engageable member 252 can be drawn together to such an extent such that the flange 240 of the sliding member 234 is forced against the channel 232 of the recess 228, and the manually engageable member 252 is forced against the top surface of the stop member 236 such that the bottom surface of the stop member 236 is forced against the working surface 216 of the wheelhead member 214. When the locking member 238 (via the flange 240) and the stop member 236 (via the manually engageable member 252) are forced against opposing surfaces of the wheelhead member 212 (the channel 232 and the working surface 216, respectively), the holding member 214 can be said to be in a selectively locked state. As such, the holding members 214 of the exemplary holding device 210 can be locked and unlocked in any location along the holding member slots 226 by simply rotating the manually engageable member 252.

The degree to which the manually engageable member 252 is rotated may directly affect how much load is applied to the wheelhead member 212 via the holding member 214. Stated differently, the degree to which the holding members 214 are selectively locked to the wheelhead member 212 may depend upon the amount of load applied to the wheelhead member 212. As a result, in use, the holding members 214 are selectively locked with respect to the wheelhead member 212 and device 10 to a degree that prevents translation of the holding member 214 by forces exerted during rotation of the device 210.

Typically, a potter will lock the position of the holding members 214 by rotating the locking members 238 until enough resistance is encountered such that it becomes uncomfortable for the potter to further rotate the locking member 238. In such a state, the amount of force or load applied by the clamping effect of the holding member 214 will typically provide more than enough resistance to resist the greatest amount of forces that the holding members 214 would experience during most pottery processes of most workpieces.

Figure 12:
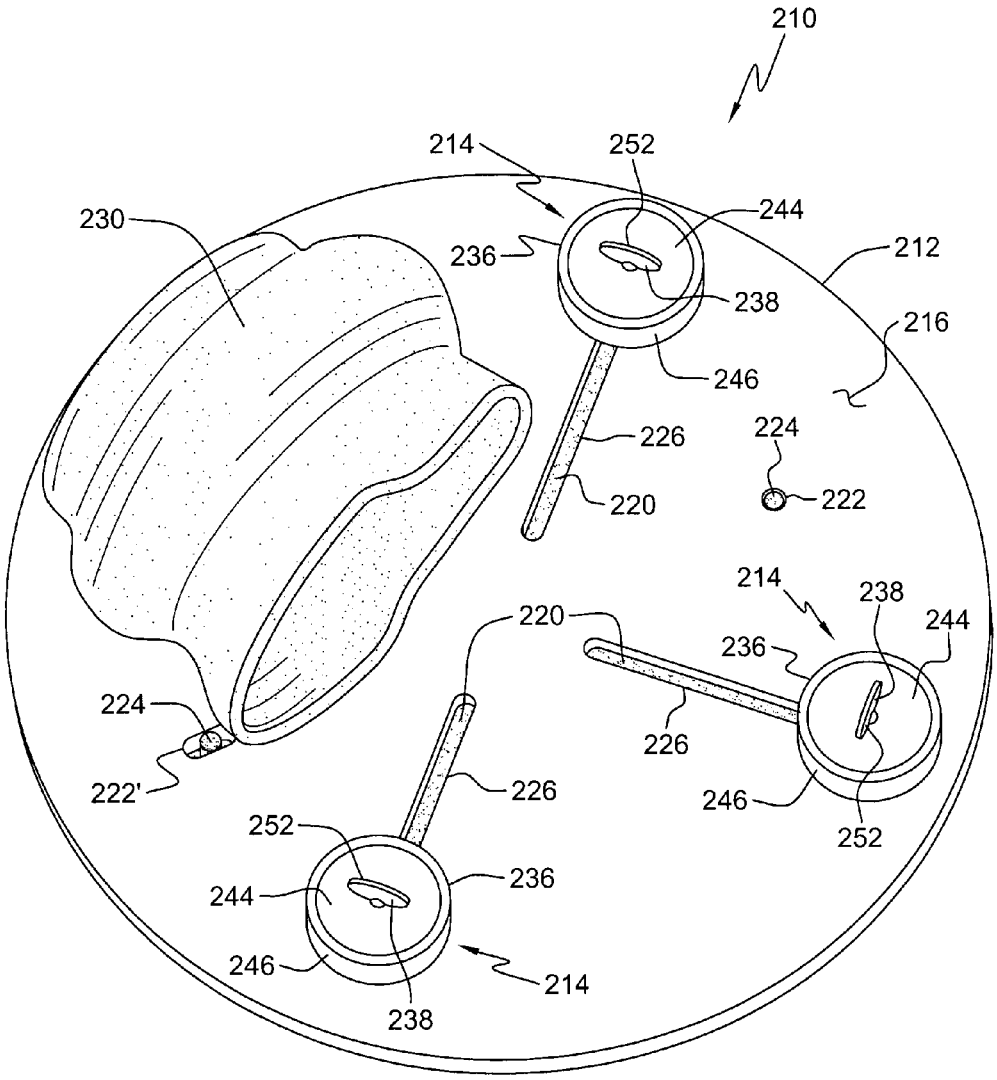
FIG. 12 is a perspective view of the third exemplary embodiment of the pottery holding device of FIG. 8 is use with an irregular or organic workpiece being applied to the device.
Figure 13:
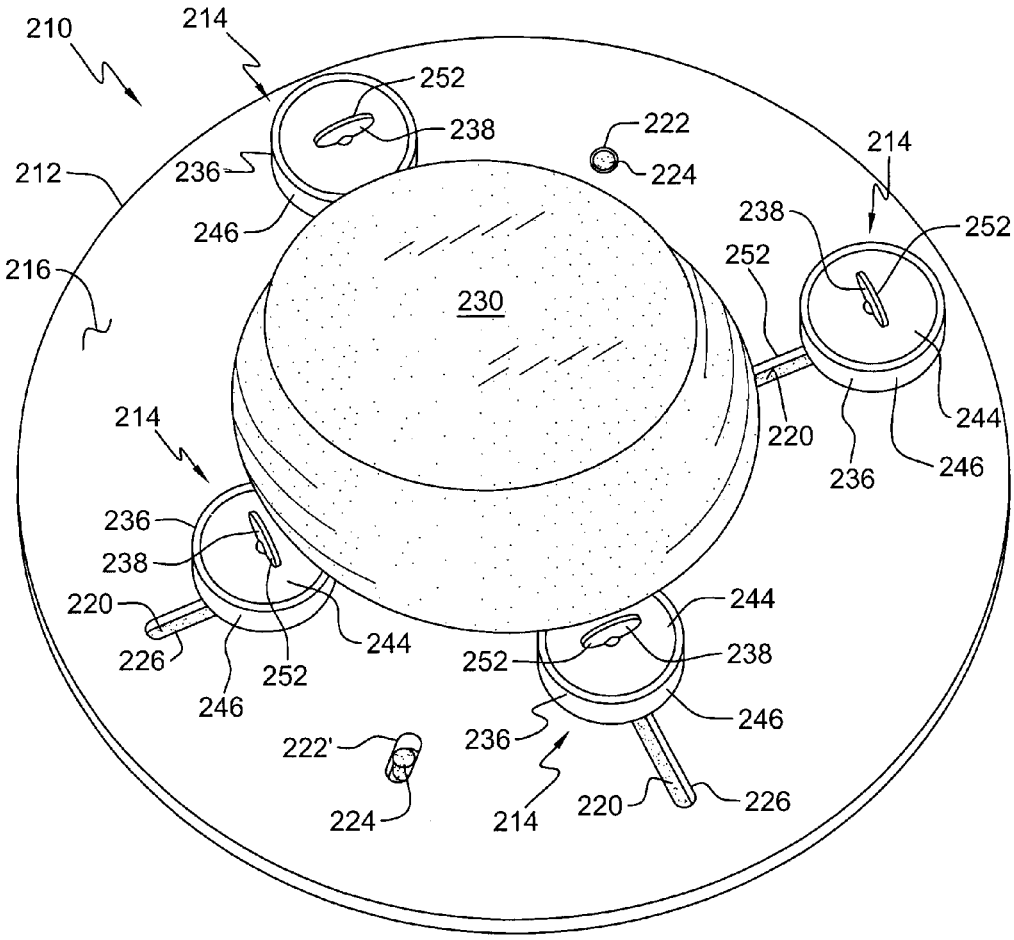
FIG. 13 is a perspective view of the third exemplary embodiment of the pottery holding device of FIG. 8 with the irregular or organic workpiece of FIG. 12 being partially secured by the holding members of the device.
Figure 14:
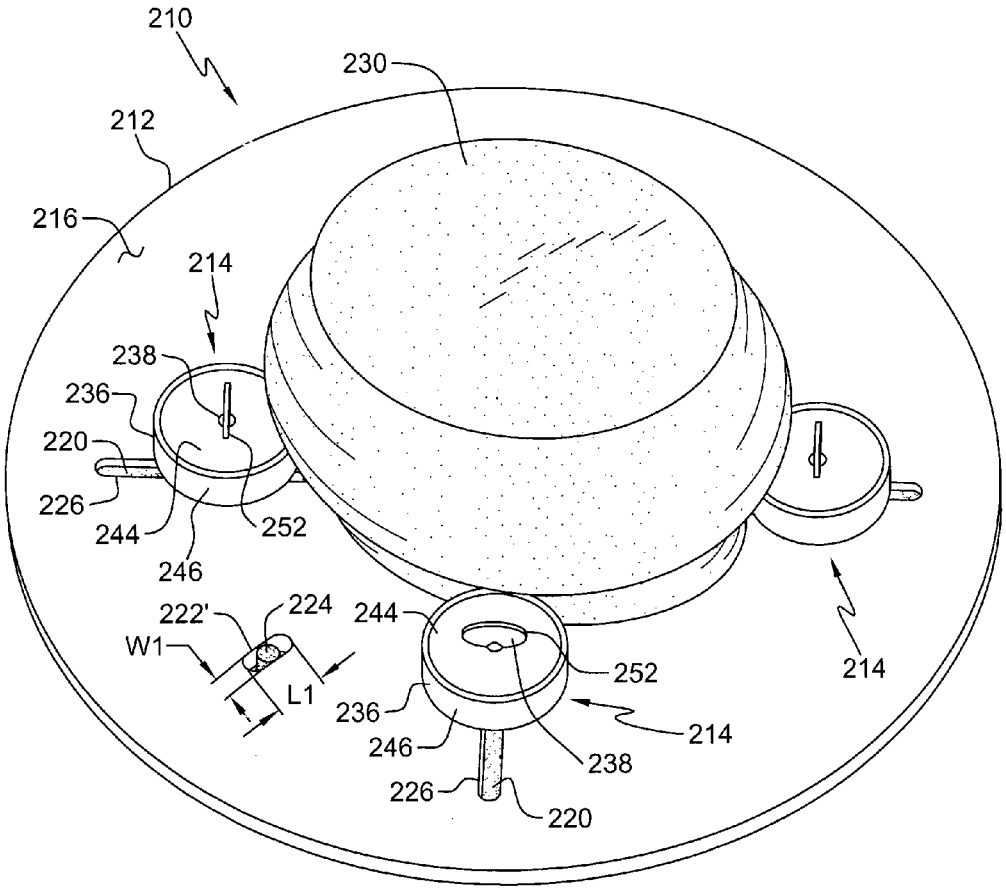
FIG. 14 is a perspective view of the third exemplary embodiment of the pottery holding device of FIG. 8 with the irregular or organic workpiece of FIG. 12 being fully secured by the holding members of the device.

In use, the exemplary device 210 is capable of securely holding both circular and non-circular symmetric workpieces and irregular or organic shaped workpieces 230 anywhere about the central portion of the wheelhead members 212, as shown in FIGS. 12-14. As can be seen from FIGS. 12-13, the pottery holding device 210 can be coupled to the wheelhead 220 by placing the wheelhead surface 214 (not shown) of the wheelhead member 212 in contact with the top surface of the wheelhead 220. The wheelhead member 212 can be oriented such that the bat pins 224 of the wheelhead 220 extend into the bat pin apertures 222, 222', as shown in FIG. 14. In such a position, the device 210 is substantially coupled to the wheelhead 220, at least to a degree that will prevent the device 210 from sliding, twisting or rotating during rotation of the wheelhead member 220. Then, with the holding members 214 retracted to positions adjacent the outer edge of the wheelhead member, a workpiece 230, such as the illustrated irregular or organic shaped workpiece 230, can be placed on the working surface 216 of the wheelhead member 212. It is noted that the workpiece 230 can be placed anywhere on the working surface 216 of the device 210 within the confines of the holding members 214. For example, the center of the workpiece can be substantially aligned with the axis of rotation and center of the device 210 (i.e., centered on the wheelhead 220) or can be placed off-center (i.e., spaced from the axis of rotation and center of the wheelhead 220) as shown in FIGS. 13 and 14.

Turning to FIGS. 13 and 14, with a workpiece 230 placed on the working surface 216, the holding members 214 can repositioned into abutment with the workpiece 230 to securely hold the workpiece 230 in its particular position and orientation during rotation of the device 10 via the wheelhead 220. For example, after an irregular or organic shaped workpiece 230 is placed on the wheelhead member 212, the holding members 214 can be individually selectively locked in abutment with the portion of the outer surface of the workpiece 230 that is aligned with the particular holding member slot 226, as shown in FIG. 13. To reposition a particular holding member 214 that is selectively locked in a position adjacent the outer edge of the wheelhead member 212, a potter can engage and rotate the manually engageable member 252 of the locking member 238 in a first direction to unload the particular holding member 214 to put the holding member 214 into a slidably coupled state. However, a holding member 214 may not be in the selectively locked state when it is positioned adjacent the outer edge of the wheelhead member 212, but rather may already be in the slidably coupled state.

When a particular holding member 214 is configured in a slidably coupled state and positioned adjacent the outer edge of the wheelhead member 212, a potter can manually engage the particular holding member 214 and slide the holding member 214 along the associated holding member slot 226 such that the abutment member 246 of the stop member 236 is in abutment with the portion of outer surface of the workpiece 230 that is aligned with the holding member slot 226. It is noted that the abutment member 246 may be positioned adjacent the surface of the workpiece 230 such that force is not exerted on the workpiece 230 before the device 210 is rotated (such as being spaced a relatively small distance away from the workpiece 230). Conversely, the abutment member 246 may be positioned in contact with the workpiece 230 such that a force is exerted on the workpiece 230 before the device 210 is rotated (such as a position where the abutment member 246 is deformed by the workpiece 230). The term "abut" or "abutment" is used herein to refer to either of these two states.

Once a particular holding member 214 is translated into abutment with the workpiece 230, a potter can selectively lock the holding member 214 in the abutment position by engaging the manually engaging member 252 of the locking member 236 and rotating the locking member 236 in a second direction. As described above, when the locking member 238 of a particular holding member 214 is rotated in a second direction, the holding member 214 clamps onto the wheelhead member 212 to secure the holding member 214, and a workpiece 310 in abutment therewith, during rotation of the device 210. As also described above, a potter will typically rotate the locking members 238 until enough resistance is encountered such that it becomes uncomfortable for the potter to apply more rotational force to the manually engaging member 252. These holding member translation and locking steps can be repeated for each of the at least four illustrated holding members 214 to securely hold the workpiece 230 during rotation of the wheelhead 220, as depicted in FIGS. 13 and 14. As such, the illustrated at least four holding members 214 can abut at least four separate and distinct points of the workpiece.

FIGS. 15A-D illustrate top views of the exemplary holding device 210 with four exemplary holding members 214 in the locked state securely holding three workpieces 230A-B, 230C and 230D of differing shapes (the outer periphery of the workpieces 230A-B, 230C and 230D defines differing shapes, at least when viewed from above the axis of rotation of the device 210). The holding members 214 securely hold the workpieces 230A-B, 230C and 230D by providing at least four points of contact about the periphery of the workpieces 230A-B, 230C and 230D.

Figure 15A:
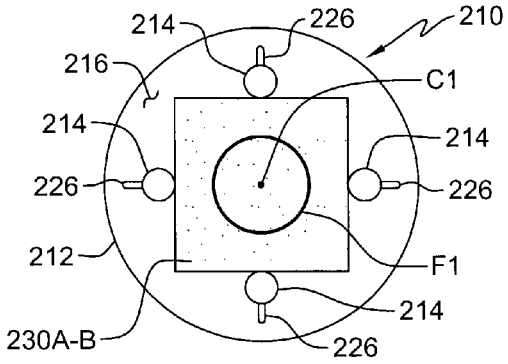
FIGS. 15A-15D are tops views illustrating the forming of a foot on differently shaped workpieces with the pottery holding device of FIG. 8.
Figure 15B:
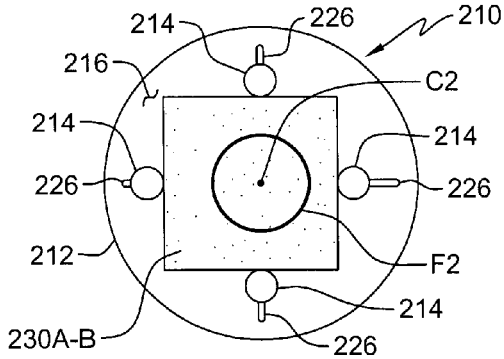

In FIGS. 15A and 15B, the exemplary workpiece 230A-B defines a substantially square shape. In the arrangement illustrated in FIG. 15A, the exemplary square workpiece 230A-B is secured to the device 10 such that it is centered on the wheelhead member center C1. Stated differently, the center of the square workpiece 230A-B is aligned with the center C1 of the wheelhead 212 and thus the axis of rotation of the device 210. Because the center of the square workpiece 230A-B is aligned with the axis of rotation of the device 210, a circular foot F1 can be trimmed into the workpiece 230A-B such that the foot is centered on the square workpiece A-B so the workpiece A-B maintains four lines of symmetry. In the arrangement illustrated in FIG. 15B, the exemplary square workpiece 230A-B is secured to the device 10 such that it is shifted from the center of the wheelhead member center C2. Stated differently, the center of the square workpiece 230A-B is spaced from the center C2 of the wheelhead 212 and thus the axis of rotation of the device 210. Because the portion of the square workpiece 230A-B that is aligned with the axis of rotation of the device 210 is spaced from the center of the workpiece 230A-B, a circular foot F2 can be trimmed into the workpiece 230A-B such that the foot F2 is off-center and the workpiece 230A-B loses at least one line of symmetry.

Figure 15C:
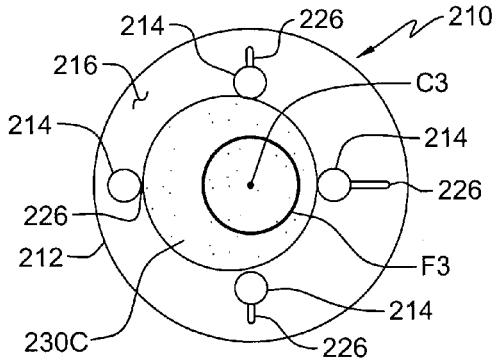

In the arrangement illustrated in FIG. 15C, an exemplary circular workpiece 230C is secured to the device 10 such that it is shifted from the center C3 of the wheelhead member 212. Stated differently, the center of the circular workpiece 230C is spaced from the axis of rotation of the device 210. Because the portion of the circular workpiece 230C that is aligned with the axis of rotation of the device 210 is spaced from the center of the workpiece 230C, a circular foot F3 can be trimmed into the workpiece 230C such that the foot F3 is off-center and the workpiece 230C loses at least one line of symmetry. The off-center position of the workpiece 230C results in the holding members 214 being positioned differently along the holding member slots 226. It is noted however, that like with the square workpiece 230A-B of FIG. 15A, the circular workpiece 230C could have been centered on the wheelhead member 212 so the foot F3 is centered on the workpiece 230C to maintain its symmetry.

Figure 15D:
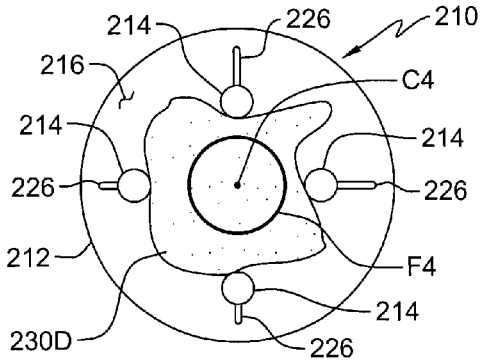

In FIG. 15D, the exemplary workpiece 230D defines an irregular or organic shape. The irregular or organic workpiece 230D was oriented and positioned with respect to the center of the wheelhead C4 based on the potter's judgment of where the foot F4 should be formed to produce an aesthetically pleasing product. Once the orientation and position was determined, the holding members 214 were moved into abutment with the outer surface of the workpiece 230D and selectively locked. Due to the irregular shape, each holding member 214 is positioned differently along the holding member slots 226, as shown in FIG. 15D. As the irregular or organic workpiece 230D lacks an identifiable center, the flexibility of the device 210 in allowing the potter to securely hold the workpiece 230D in relatively any position and orientation is particularly advantageous.

Figure 16:
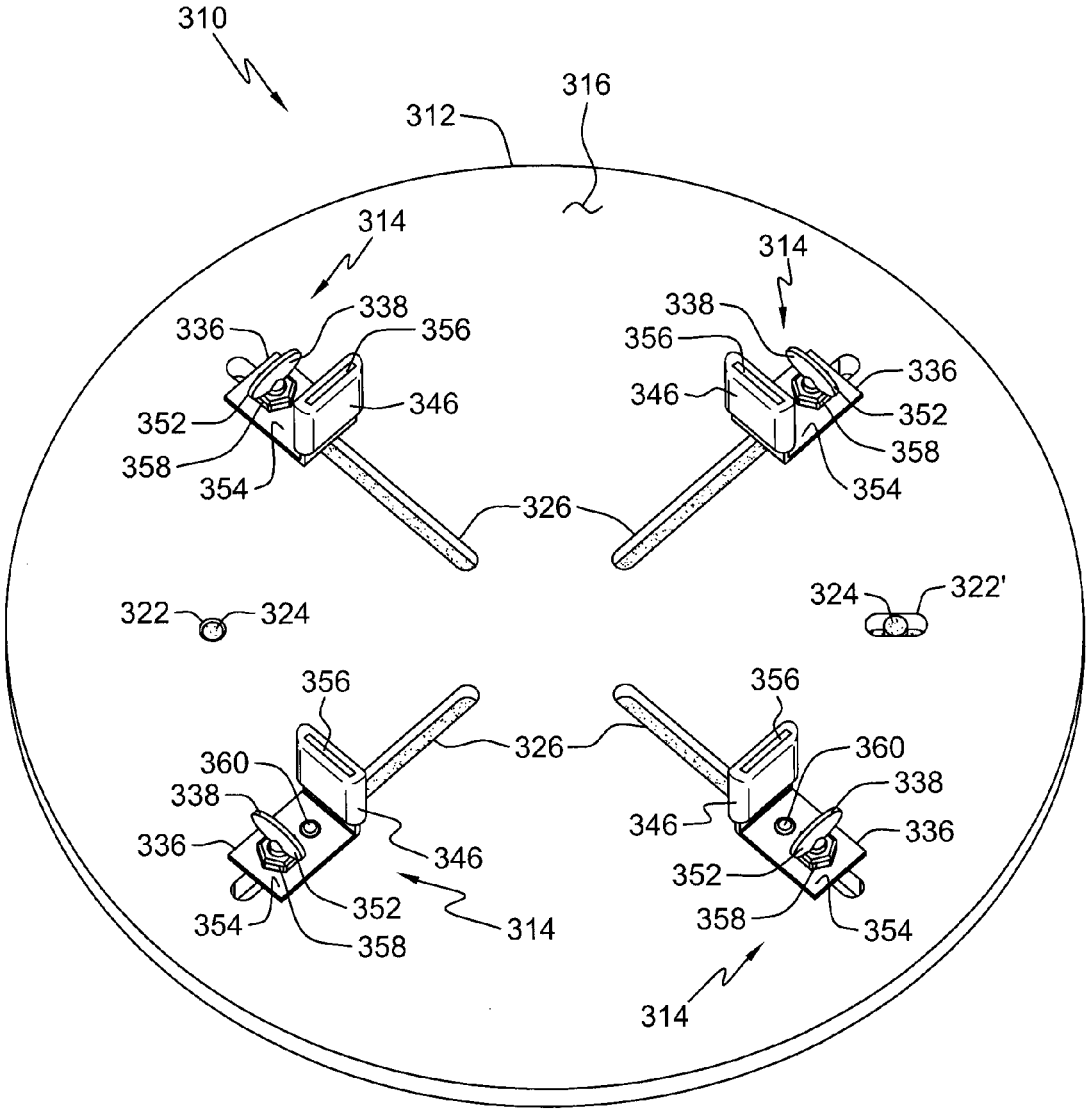
FIG. 16 is a perspective view of a fourth exemplary embodiment of a pottery holding device of the present invention applied to a wheelhead of an exemplary pottery wheel.
Figure 17:
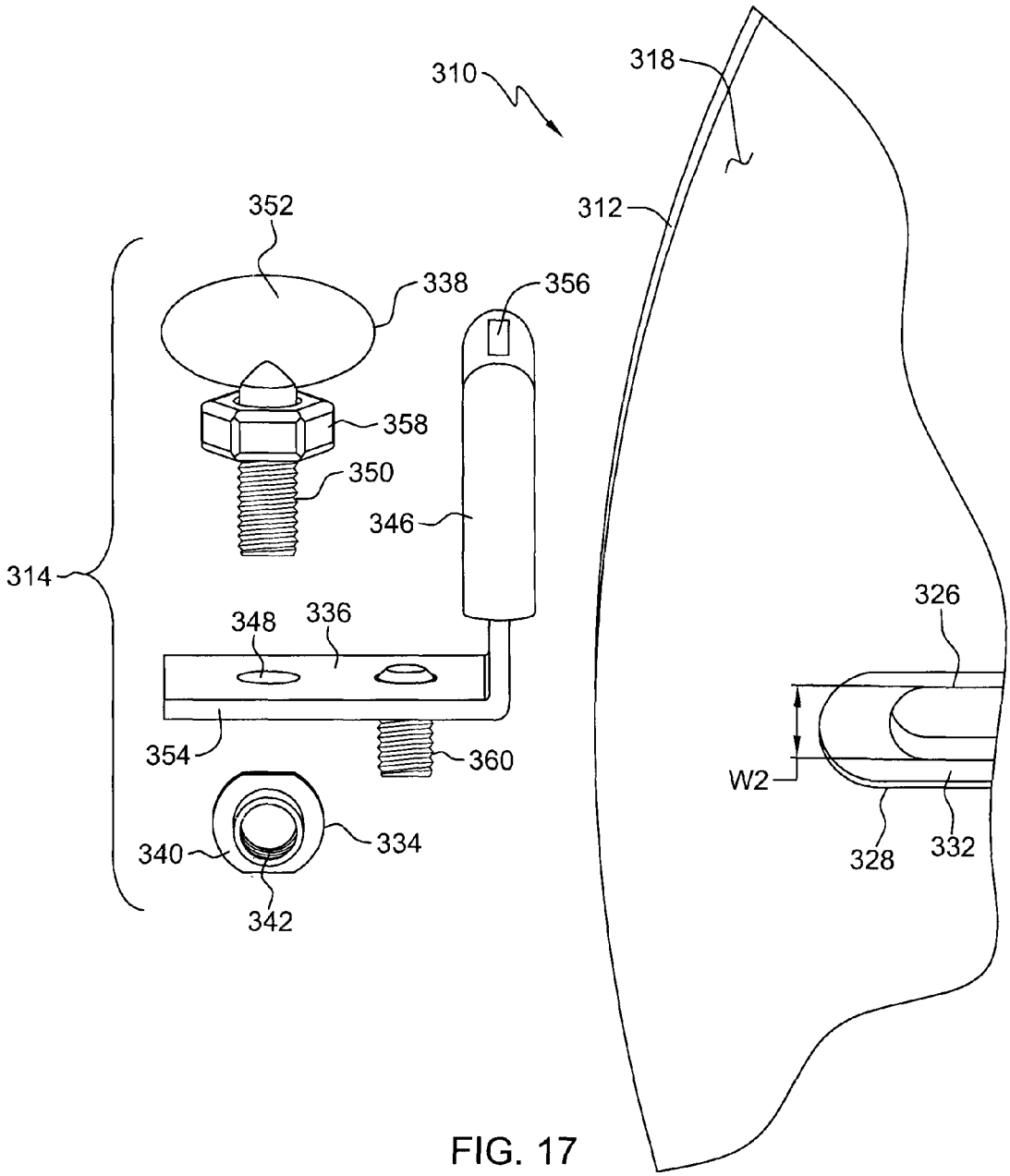
FIG. 17 is a perspective view of the fourth exemplary embodiment of the pottery holding device of FIG. 16 showing the bottom surface of the device and the holding members of the device in an unassembled state.

In FIGS. 16 and 17, another exemplary pottery holding device embodying a fourth embodiment of the present invention is indicated generally by the reference numeral 310. The exemplary pottery holding device 310 is substantially the same as the exemplary pottery holding device 210 described above with reference to FIGS. 8-15, and therefore like reference numerals preceded by the numeral "3", as opposed to the number "2", are used to indicate like elements. The wheelhead member 310 of the pottery holding device 310 is substantially the same as the wheelhead member 210 of the pottery holding device 210, and therefore the illustrations of FIGS. 8-15 and the associated detailed description equally apply to the wheelhead member 310 of FIGS. 16 and 17. The exemplary pottery holding device 310 differs from the exemplary pottery holding device 210 with respect to the configuration of the holding members 314.

The pottery holding device 310 includes at least three holding members 314 provided in the corresponding holding member slots 326 for selectively fixing the holding members 314 about a workpiece 330. In the illustrated embodiment, the pottery holding device 310 includes four holding members 314, and thus four corresponding holding member slots 326. The holding members 314 utilize the sliding member 334 for interaction with the recesses 328 and holding member slots 326, as described above with respect to the holding members 214 of the holding device 210. Similarly, the holding members 314 also utilize the fixing member 338 for interaction with the sliding member 334 to selectively clamp the holding members 314 to the wheelhead member 312 to provide both slidably coupled and selectively fixed states, as described above with respect to the holding members 214 of the holding device 210. The exemplary stop members 336 of the holding members 314 of the device 310 define an "L" shape, as opposed to the disc-shape of the exemplary stop members 236 of the holding members 214 of the device 210.

As shown in FIGS. 16 and 17, the "legs" of the exemplary L-shaped stop members 336 of the holding members 314 may define an exemplary support member 354 and an exemplary riser member 356. The exemplary support member 354 may be substantially planar and include an aperture 348 shaped and sized to allow the threaded post 350 of the fixing member 338 to pass therethrough. Like with the core 244 of the holding members 210 described above, in the slidably coupled state the bottom surface of the support member 354 may slidably engage the working surface 316 of the wheelhead member 312, and in the selectively fixed state the bottom surface of the support member 354 may clamp down on the working surface 316 to fix the holding member 314 to the wheelhead 312. The exemplary riser member 356 may extend from the support member 354 to form an "L" shape, as in the embodiment illustrated in FIGS. 16 and 17. As such, the riser member 356 may extend from the support member 354 substantially normally away from the working surface 316 to provide an elevated portion to securely hold a workpiece 330 with an elevated or extended outer surface. At least a portion of the riser member 356 may include an abutment member 346 provided thereon to provide a flexible or soft outer surface, at least compared to the surface of riser member 356 itself.

As shown best by FIG. 17, the bottom surface of the support member 354 may include a protrusion 360 aligned with, and spaced from, the fixing element aperture 348. The protrusion 360 may be sized and shaped to at least partially extend into the holding member slots 326. For example, in the illustrated embodiment, the protrusion 360 is cylindrical and defines a diameter substantially similar to the width W2 of the holding member slots 326. In such a configuration, when the holding members 314 are slidably coupled or selectively locked to the wheelhead member 312, the protrusion 360 of the support member 354 is carried in the holding member slots 326 and prevents substantial rotation of the holding members 314.

As also shown best by FIG. 17, the locking member 338 may include a spacer 358 to provide a bearing surface spaced from the distal end of the threaded pin 350. The spacer 358 may provide a proper spacing between the bearing surface, the distal end of the threaded pin 350, and the height of the internally threaded post 342, so that when the locking member 338 is rotated via the manually engageable member 254 from the slidably coupled state to the selectively coupled state, the spacer 358 bears down on the support member 336 to clamp the holding member 314 to the wheelhead 312 (i.e., the locking member 338 is prevented from "bottoming out").

Figure 18:
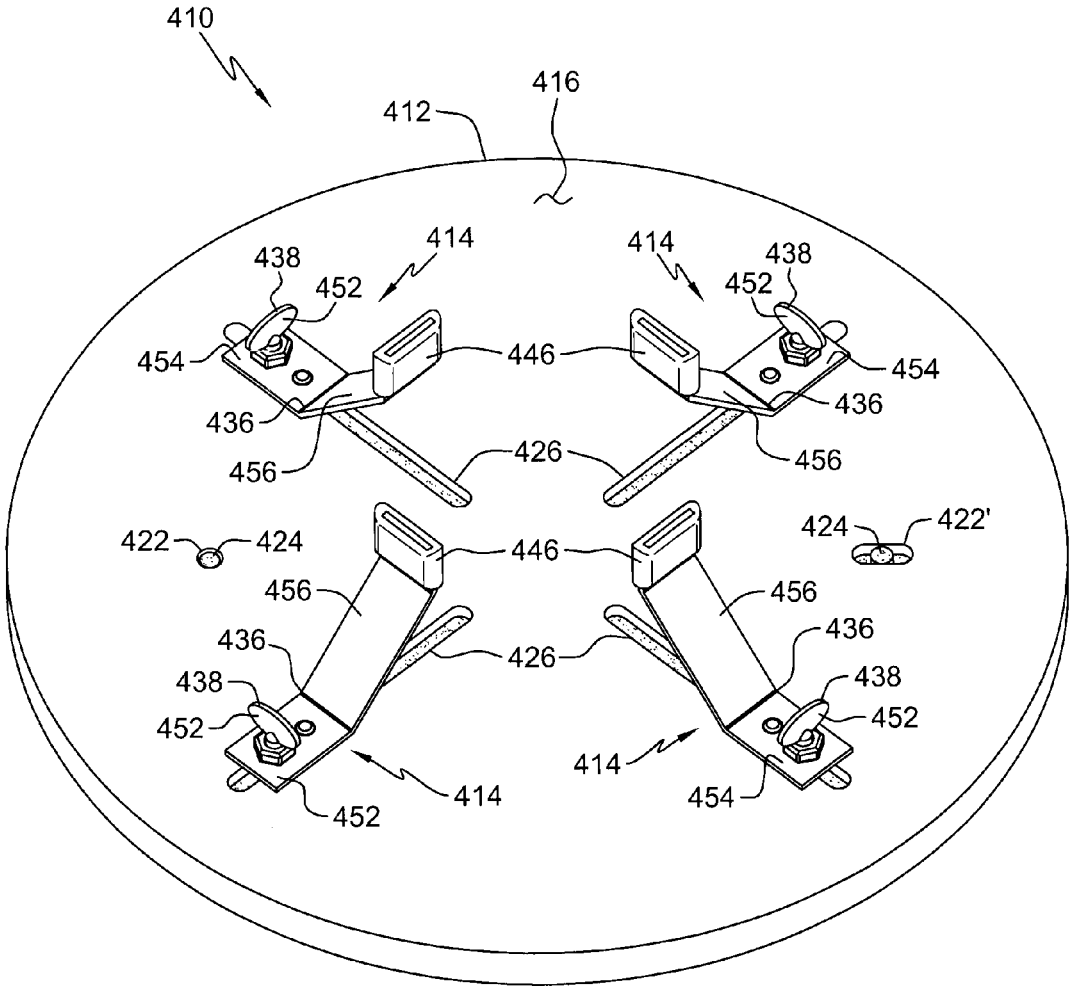
FIG. 18 is a perspective view of a fifth exemplary embodiment of a pottery holding device of the present invention applied to a wheelhead of an exemplary pottery wheel.
Figure 19:
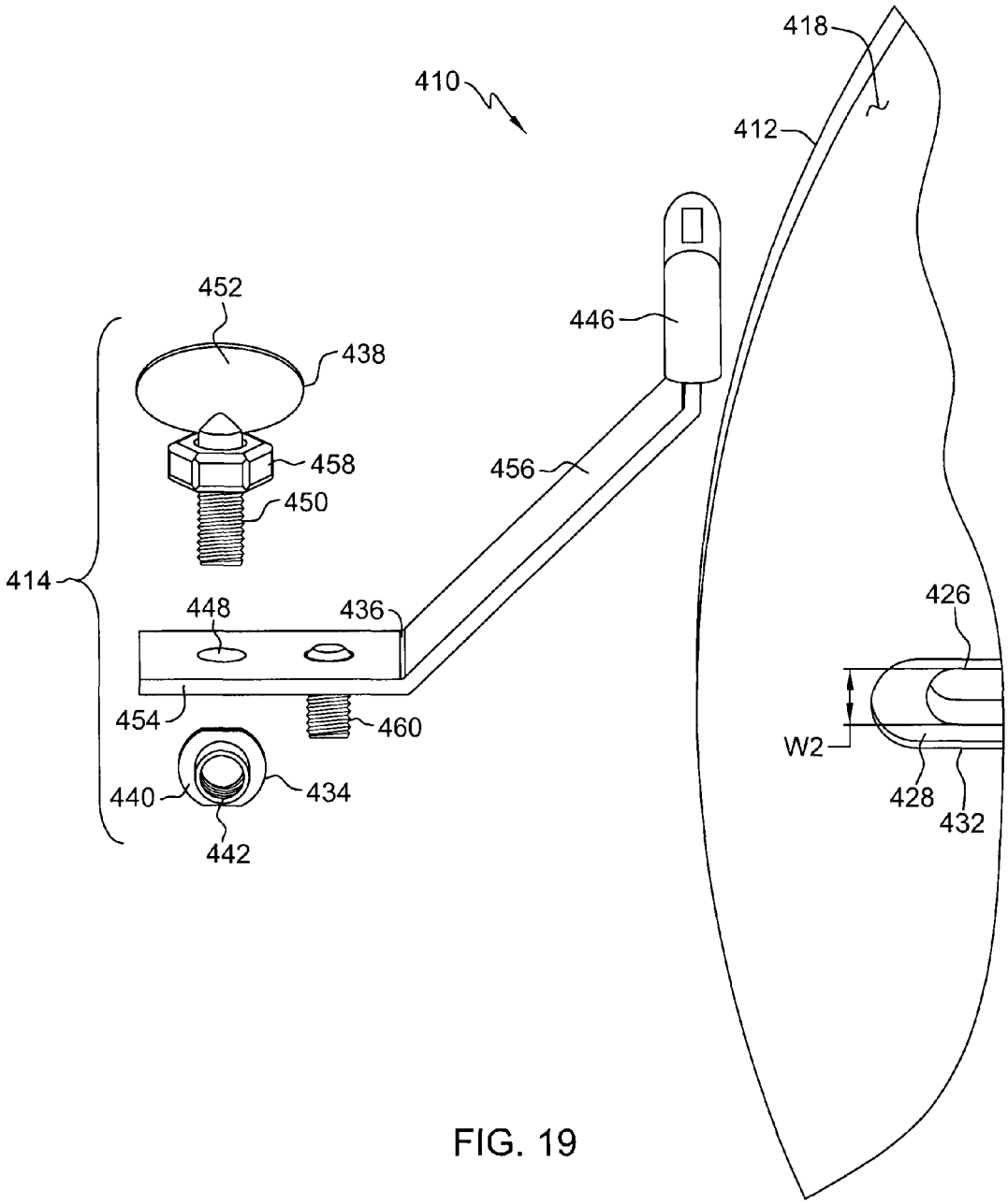
FIG. 19 is a perspective view of the fourth exemplary embodiment of the pottery holding device of FIG. 18 showing the bottom surface of the device and the holding members of the device in an unassembled state.

In FIGS. 18 and 19, another exemplary pottery holding device embodying a fifth embodiment of the present invention is indicated generally by the reference numeral 410. The exemplary pottery holding device 410 is substantially similar to the exemplary pottery holding device 210 and the exemplary pottery holding device 310 described above with reference to FIGS. 8-15 and FIGS. 16 and 17, respectively, and therefore like reference numerals preceded by the numeral "4", as opposed to the number "2" or the number "3", are used to indicate like elements. The wheelhead member 412 of the pottery holding device 410 is substantially the same as the wheelhead member 212 of the pottery holding device 210 and the wheelhead member 312 of the pottery holding device 310, and therefore the illustrations of FIGS. 8-17 and the associated detailed description equally apply to the wheelhead member 412 of FIGS. 18 and 19. The exemplary pottery holding device 410 differs from the exemplary pottery holding device 210 with respect to the configuration of the holding members. However, the holding members 414 of the pottery holding device 410 are similar to the holding members 314 of the pottery holding device 310, and therefore the illustrations of FIGS. 16 and 17 and the associated detailed description equally apply to the holding members 414 of FIGS. 18 and 19. The exemplary holding members 414 differ from the exemplary holding members 314 with respect to the configuration of the stop members 336.

As shown in FIGS. 18 and 19, the exemplary riser member 456 may extend from the support member 454 at an obtuse angle with respect to the top surface of the support member 454 (i.e., at acute angle with respect to the working surface 416) to provide an elevated and internally-extended portion to securely hold a workpiece with an elevated outer surface and a narrow width or diameter, such as a vase. The distal end of the riser member 456 provided with the abutment member 346 may be oriented such that it extends substantially normal to the working surface 416 to provide a flat surface with a relatively large surface area to contact a workpiece 430.

Figure 20:
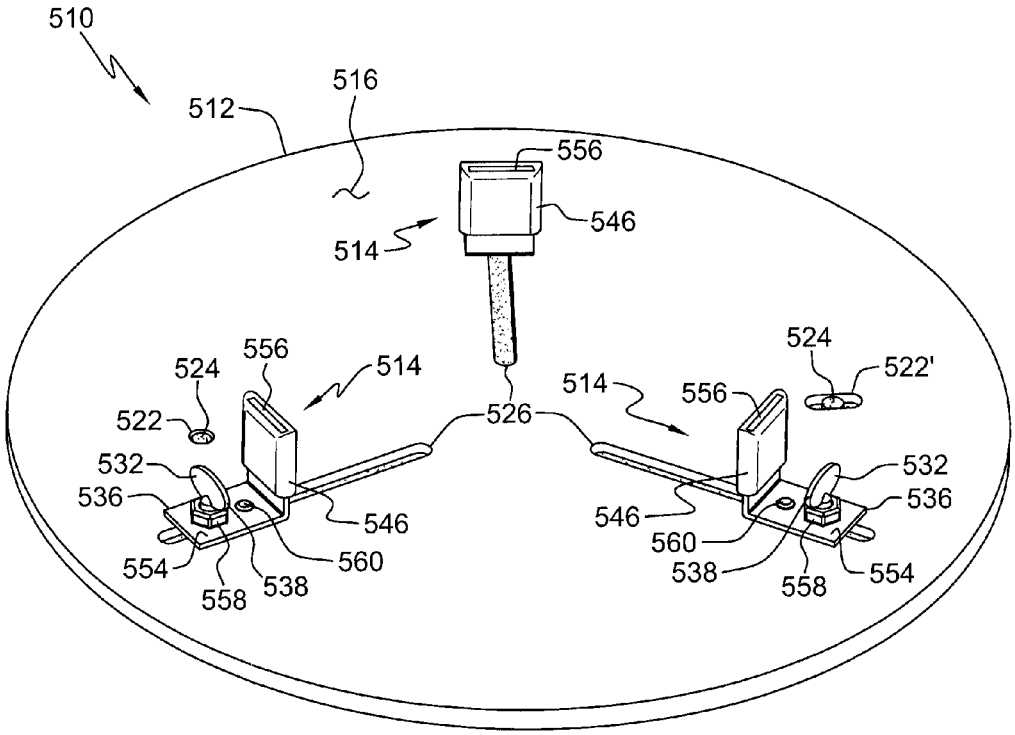
FIG. 20 is a perspective view of a sixth exemplary embodiment of a pottery holding device of the present invention applied to a wheelhead of an exemplary pottery wheel.

In FIG. 20, another exemplary pottery holding device embodying a sixth embodiment of the present invention is indicated generally by the reference numeral 510. The exemplary pottery holding device 510 is substantially similar to the exemplary pottery holding device 210, the exemplary pottery holding device 310, and the exemplary pottery holding device 410 described above with reference to FIGS. 8-19, and therefore like reference numerals preceded by the numeral "5", as opposed to the number "2", the number "3" and the number "4", are used to indicate like elements. The exemplary holding members 514 of the pottery holding device 510 are substantially similar to the holding members 314 of the pottery holding device 310, and therefore the illustrations of FIGS. 16 and 17 and the associated detailed description equally apply to the holding members 514 of FIG. 20.

The exemplary pottery holding device 510 otherwise differs from the exemplary pottery holding device 210, the exemplary pottery holding device 310, and the exemplary pottery holding device 410 described above with respect to the number of holding members 514. As such, the number of respective slots 526 and recesses 528 of the exemplary wheelhead member 512 differs from the number of respective slots 226, 326, 426 and recesses 228, 328, 428 of the wheelhead members 212, 312, 412 of the exemplary pottery holding devices 210, 310, 410.

As shown in FIG. 20, the exemplary pottery holding device 510 includes an the exemplary wheelhead member 512 with three slots 526 and three respective recesses 528 disposed about the wheelhead member 512. As such, at least three exemplary holding members 514 are provided. In the exemplary illustrated embodiment, the at least three slots 526, recesses 528 and respective holding members 514 are disposed symmetrically about the wheelhead member 512, and therefore are spaced about 120 degrees from one another. It is noted that although exemplary pottery holding device 510 includes holding members 514 of the design of exemplary pottery holding device 310, it is hereby contemplated that any type or configuration of holding members may be used in exemplary pottery holding device 510, such as exemplary holding members 214 and 414. Similarly, the exemplary holding device 210 of FIGS. 1-7 may include at least three holding members 16 (as opposed to at least four holding members 16).

Although the exemplary pottery holding device 510 may not be particularly advantageous for securely holding some organic or four-sided workpieces, such as square or rectangular workpieces, the exemplary pottery holding device 510 is capable of securely holding some circular, symmetric, three-sided, organic and other shaped workpieces that can be secured by three points of contact. As such, exemplary pottery holding device 510 is particularly advantageous for securely holding workpieces that can be supported by three points of contact in both centered and off-centered arrangements. As such, the exemplary pottery holding device 510 can be used to securely hold a workpiece that can be supported by three points of contact off-center of the wheelhead member 512, and thus off-center from the axis of rotation. The exemplary pottery holding device 510 thereby allows the potter to decide where to secure on the wheelhead member 510 such workpieces that can be supported by three points of contact—such as either centered or off-centered locations on the wheelhead member 512, and thus centered or off-centered from the axis of rotation. For example, the exemplary pottery holding device 510 securely holds and allows a potter to decide where to form the foot on workpieces that can be supported by three points of contact (via deciding which portion of such workpieces should be placed on the center of the wheelhead 512, and thus aligned with the axis of rotation).

One advantage of the illustrated embodiments of the present invention is that the pottery holding devices are relatively thin and thereby sit relatively low in pottery wheels that include splash pans so that trimmings or other debris are adequately caught by the splash pan. Another advantage of the illustrated embodiments of the present invention is that the pottery holding devices properly function with pottery wheels that rotate either clock-wise or counter-clockwise. Another advantage of the illustrated embodiments of the present invention is that the pottery holding devices securely hold workpieces of different shapes, sizes and configurations, such as irregular or organic workpieces. Another advantage of the illustrated embodiments of the present invention is that the pottery holding devices can securely hold workpieces, including circular, non-circular symmetric, asymmetric, three-sided, four-sided and organic workpieces, in both centered and off-centered positions and/or orientations selected by a potter.

As may be recognized by those of ordinary skill in the pertinent art based on the teachings herein, numerous changes and modifications may be made to the above-described and other embodiments of the present invention without departing from the spirit of the invention as defined in the claims. For example, the components of the pottery holding devices may be made of any of numerous different materials that are currently or later become known for performing the functions of such components. In addition, not all elements or all features disclosed herein are necessary, and if desired, additional elements or features may be added. Further, components, aspects or combinations thereof described with a particular embodiment may be incorporated in another described embodiment to achieve the same or similar function as it achieved in the particular embodiment. Similarly, the components of the pottery holding devices may take any of numerous different shapes and/or configurations. For example, the wheelhead members may include one bat pin aperture, more than two bat pin apertures, or not include any bat pin apertures so that a potter can selectively make their own apertures to customize the device for a particular wheelhead. As another example, the holding member slots may not be symmetrically disposed radially about the wheelhead member, but rather may be asymmetrically or partially symmetrically radially disposed on the wheelhead member. Similarly, the holding member slots may define differing lengths and widths, and may be located at differing distances from the center of wheelhead. As yet another example, the post of the sliding member may be externally threaded and the pin of the locking member may be internally threaded. Alternatively, the sliding member and the locking member may be alternatively designed or configured in any known manner capable of providing selective clamping or locking and unlocking of the holding members to the wheelhead member, such as cam lever clamps to quickly and securely load and unload the sliding member, holding member, wheelhead member and/or locking member. Still further, the holding members may include other components, or may include fewer components. For example, the sliding member and/or stop member may include another member that is disposed between them and the corresponding surface of the wheelhead member, such as washers. As another example, the stop members may not include an abutment member, as the stop members themselves may provide sufficient rigidity and softness to securely hold a workpiece without scratching or marring the surface of the workpiece.

Accordingly, this detailed description of the illustrated and exemplary embodiments of the present invention is to be taken in an illustrative, as opposed to a limiting sense.

What is claimed is:

1. A device for attachment to a wheelhead of a pottery wheel for securely holding a workpiece during rotation of the wheelhead and device, the device comprising:

a wheelhead member including a substantially planar bottom surface to engage at least a portion of a top surface of the wheelhead, and a substantially planar top surface defining a working surface for acceptance of the workpiece thereon, wherein the wheelhead member is made of a single piece, the wheelhead member including at least four slots through the wheelhead member; and a holding member coupled to each slot of the wheelhead member configured to abut at least four separate and distinct points of the workpiece that has been placed on the working surface of the wheelhead member, each holding member including a sliding member that is proximate the bottom surface of the wheelhead member, a stop member that is proximate the top surface of the wheelhead member, and a locking member coupled to the stop member and the sliding member, wherein the at least four holding members are independently movable with respect to one another and the wheelhead member and are selectively lockable via the locking member at differing positions along the at least four slots with respect to the wheelhead member to securely hold the workpiece to substantially maintain a predetermined position and orientation of the workpiece during rotation of the wheelhead and device.

2. A device as defined in claim 1, wherein each of the at least four holding members are manually engageable to facilitate movement and locking of the holding members along an entirety of the at least four slots.

3. A device as defined in claim 2, wherein the device is configured such that each holding member is movable and lockable between:

(1) a first position wherein the at least four holding members abut at least four separate and distinct points of said workpiece, and each holding member being selectively locked with respect to the wheelhead member to securely hold the workpiece to substantially maintain a position and orientation of the workpiece during rotation of the wheelhead and device; and (2) a second position wherein the at least four holding members are spaced from the first position to allow the workpiece to be placed on, or removed from, the working surface of the wheelhead member.

4. A device as defined in claim 1, wherein the wheelhead member includes at least two apertures extending from the bottom surface towards the top surface, the at least two apertures being shaped and sized to at least partially receive a bat pin of the wheelhead therein.

5. A device as defined in claim 4, wherein the wheelhead member defines a substantially circular shape when viewed from an axis of rotation of the wheelhead when the wheelhead member is engaged to the wheelhead, and wherein the at least two apertures are positioned in the wheelhead member such that when the wheelhead member is engaged to the wheelhead, a bat pin of the wheelhead member is at least partially received in each aperture and a center of the wheelhead member is substantially aligned with the axis of rotation of the wheelhead.

6. A device as defined in claim 5, wherein the wheelhead member includes a magnetic material disposed substantially throughout the wheelhead member.

7. A device as defined in claim 2, wherein the slots extend from the bottom surface to the top surface of the wheelhead member.

8. A device as defined in claim 7, wherein the wheelhead member defines a substantially circular shape when viewed from the axis of rotation of the wheelhead when the wheelhead member is engaged to the wheelhead, and wherein the slots are disposed about the axis of rotation and extend along a radial direction extending generally between the axis of rotation and an outer periphery of the wheelhead member.

9. A device as defined in claim 1, wherein at least one of the sliding member and the locking member of the holding members extend at least partially through the slots.

10. A device as defined in claim 3, wherein each slot includes a recess disposed about the slot in the bottom surface of the wheelhead member, and wherein the sliding member is threadably coupled to the locking member and is positioned at least partially within the recess of a corresponding slot such that it is prevented from substantially rotating within the recess.

11. A device as defined in claim 10, wherein rotation of the locking member in a first direction draws the locking member and the sliding member toward one another, and wherein in the first position the locking member has been selectively manually rotated in the first direction to such a degree that the sliding member exerts force against the recess and the stop member exerts force against the working surface about the corresponding slot to selectively lock each holding member to the wheelhead member.

12. A device as defined in claim 11, wherein the holding members are moved from the first position to the second position by manual rotation of the locking member in a second direction that is substantially opposite to the first direction to such a degree that the forces between the sliding member, the stop member, and the wheelhead member are reduced so that the holding member is slidably coupled to the wheelhead along the corresponding slot, and by manually sliding the holding member away from a center of the wheelhead.

13. A device as defined in claim 1, wherein the stop member is a substantially disc-shaped stop member or a substantially L-shaped stop member.

14. A device for attachment to a wheelhead of a pottery wheel for securely holding a workpiece during rotation of the wheelhead and device, the device comprising:

a first means for engaging the top surface of the wheelhead and for accepting the workpiece on a top surface thereof, wherein the first means is made of a single piece the first means including an axis of rotation and at least four substantially radially-extending slots disposed about the axis of rotation and extending through the first means; and at least four holding members configured to abut at least four separate and distinct points of the workpiece at a periphery of the workpiece positioned on the first means, each holding member being coupled to a corresponding slot of the at least four substantially radially-extending slots and including a sliding member proximate the top surface of the wheelhead, a stop member proximate the top surface of the first means, and a locking member coupled to the stop member and the sliding member, wherein the holding members are selectively independently movable with respect to one another and the first means and are selectively lockable to the first means at differing positions along the at least four slots, with respect to the first means to securely hold the workpiece to substantially maintain a predetermined position and orientation of the workpiece during rotation of the wheelhead and device, and wherein rotation of each locking member in a first direction draws the locking member and a corresponding sliding member toward one another to such a degree that the sliding member exerts a force against a bottom surface of the first means and the stop member exerts a force against the top surface of the first means to selectively lock each holding member.

15. A device as defined in claim 14, wherein each of the holding members are manually engageable to facilitate movement of the holding members between at least two positions.

16. A device as defined in claim 15, wherein the device is configured such that the at least two positions include:

(1) a first position wherein the at least four holding members abut at least four separate and distinct points of the periphery of said workpiece and at least two holding members are positioned at differing positions along their corresponding slots as compared to each other, and each holding member being selectively locked with respect to the slots of the first means in abutment with the workpiece to securely hold the workpiece on the top surface of the first means to substantially maintain the position and orientation of the workpiece during rotation of the device; and (2) a second position wherein the at least four holding members are spaced from the first position to allow the workpiece to be placed on, or removed from, the top surface of the first means.

17. A device as defined in claim 16, wherein the first means is a wheelhead member including a substantially planar bottom surface configured to engage at least a portion of the top surface of the wheelhead, and the top surface of the wheelhead member is a substantially planar top surface defining a working surface for acceptance of the workpiece thereon.

18. A device as defined in claim 17, wherein the at least four substantially radially-extending slots are substantially linear radially-extending slots symmetrically disposed about the wheelhead member.

* * * * *